US008650809B2

(12) United States Patent
Kaiser et al.

(10) Patent No.: US 8,650,809 B2
(45) Date of Patent: Feb. 18, 2014

(54) ROOF SPOILER

(75) Inventors: Bruce A. Kaiser, Clearwater, FL (US); James R. Oldham, Woodstock, VT (US); Anthony M. DeMore, Willoughby, OH (US); Jesse P. Carlson, Chagrin Falls, OH (US); Jennifer M. Morzano, Long Branch, NJ (US)

(73) Assignee: Windtripper Corporation, Clearwater, FL (US)

( * ) Notice: Subject to any disclaimer, the term of this patent is extended or adjusted under 35 U.S.C. 154(b) by 23 days.

(21) Appl. No.: 12/773,235

(22) Filed: May 4, 2010

(65) Prior Publication Data

US 2010/0281785 A1 Nov. 11, 2010

Related U.S. Application Data

(60) Provisional application No. 61/176,026, filed on May 6, 2009.

(51) Int. Cl.
*E04H 9/16* (2006.01)
*B60J 1/20* (2006.01)

(52) U.S. Cl.
USPC ..... 52/84; 52/11; 52/94; 52/97

(58) Field of Classification Search
USPC ..... 52/24, 62, 94, 97, 84, 11; 248/48.1, 248/48.2
See application file for complete search history.

(56) References Cited

U.S. PATENT DOCUMENTS

| | | | | |
|---|---|---|---|---|
| 2,206,040 | A | 7/1940 | Ludington | |
| 2,270,537 | A | 1/1942 | Ludington | |
| 2,270,538 | A | 1/1942 | Ludington | |
| 2,536,704 | A * | 1/1951 | Shea et al. | 248/48.2 |
| 2,841,100 | A * | 7/1958 | Moller | 210/474 |
| 4,032,456 | A * | 6/1977 | Berce | 210/474 |
| 4,351,134 | A * | 9/1982 | Clarkson | 52/12 |
| 4,813,515 | A * | 3/1989 | Wigington | 182/214 |
| 4,956,950 | A * | 9/1990 | Hirose | 52/94 |
| 5,095,666 | A * | 3/1992 | Williams, Jr. | 52/11 |
| 6,182,399 | B1 * | 2/2001 | Pollera | 52/11 |
| 6,601,348 | B2 | 8/2003 | Banks et al. | |
| 7,891,141 | B2 * | 2/2011 | Kennedy | 52/11 |
| 7,905,061 | B2 * | 3/2011 | Kaiser et al. | 52/84 |
| 2006/0248810 | A1 | 11/2006 | Ewing | |
| 2007/0113489 | A1 | 5/2007 | Kaiser et al. | |

* cited by examiner

*Primary Examiner* — Phi A
(74) *Attorney, Agent, or Firm* — Gray Robinson, P.A.

(57) ABSTRACT

Disclosed is a roof spoiler that effectively disrupts the attached flow of wind upon a roof surface. This spoiler has a stowed position, whereby it is almost completely out of the view of passersby. It also has a deployed position, wherein a barrier is projected vertically, or substantially vertically, so as to disrupt the flow of air over the roof surface. This spoiler utilizes a hinged design to move between these two positions. The spoiler is specially designed to operate in conjunction with a gutter mounted along the leading edge of the roof. In the stowed position, a portion of the spoiler covers the open gutter. In one embodiment, the spoiler is L-shaped to facilitate its stability in the deployed position.

20 Claims, 23 Drawing Sheets

ROOF SPOILER

CROSS-REFERENCE TO RELATED APPLICATIONS

This is a continuation of Provisional Patent Application, Serial No. 61/176,026, filed May 6, 2009, entitled "Roof Spoiler" the disclosure of which is herby incorporated by reference herein.

FIELD OF THE INVENTION

The present invention relates to roofing systems. More particularly, it relates to an apparatus and a method for reducing wind damage to a roof.

BACKGROUND OF THE INVENTION

One of the worst types of structural damage that can befall a building is roof damage. The devastation caused by high winds, hurricanes, tornados and the like is depicted by the media, often by focusing on the damage done to homes, especially to the roofs of those homes. In these cases, damage to the roof often leads to tremendous damage to the rest of the building, as a result of structural damage, and damage caused by the elements, such as rain or snow.

The roof of a building serves a number of purposes. First, it protects the interior of the building from the elements, such as rain, snow and hail. It also serves as an important structural component of the building, often linking the walls together, and adding strength to the building.

Wind causes several different types of damage to a roof. First, the wind, when blowing in a certain direction, can flow between the roof shingles and the underlying substrate. This air flow can cause the roof shingles to peel up and lift themselves off the roof. The removal of these shingles leaves the exposed roof susceptible to water, which can now enter through the area that is no longer protected by the missing shingles. A second type of damage is caused by the effect of high speed attached flow over the surface of the roof. The deflection of the flow over the roof line squeezes the streamlines closer together, accelerating the speed and lowering the static pressure in accordance with Bernoulli's principle. This causes uplift on part or all of the roof structure, thereby exerting an upward force on the roof. This force not only causes the shingles to lift from the roof, but can also cause the roof to pull away from the joists to which it is attached.

Various attempts have been made to reduce the destructive effect of hurricane force winds on a roof, including various types of roof spoilers or wind deflectors. For example, various types of roof wind spoilers have been disclosed, for example, in U.S. Pat. Nos. 2,206,040, 2,270,537, 2,270,538, 6,601,348, and U.S. Patent Application Publication 2006/0248810. Most of these spoilers are attached directly onto the roof surface. To achieve their goal, most employ a member that, when deployed, is orthogonally disposed to the roof surface. This member may be either permanently disposed, or manually or automatically disposed only when needed. Other publications, for example U.S. Pat. No. 6,601,348, and U.S. Patent Application Publication 2007/0113489, disclose a spoiler that can be attached to the fascia, rather than the roof surface. As the air flow travels along the surface of the roof, this vertical barrier presents an obstacle to its continued flow. As a result, the wind must travel over the barrier, which causes the air flow to become turbulent. In fact, the air flow directly at the roof may reverse directions, thereby pushing the shingles down. The turbulent nature of the air flow created by these spoilers significantly decreases the negative pressure area described above. FIG. 1*a* shows the flow of air over a typical roof. Note the attached flow as the wind moves over the roof surface. FIG. 1*b* shows the resulting air flow when a roof spoiler is installed on the roof. Note the turbulence created downwind of the spoiler. Also of interest is the change in the direction of the wind along the roof surface.

Up to now, no roof spoilers have enjoyed commercial success or gained widespread use. This lack of success is probably due to a number of reasons, including unattractive appearance (e.g., due to poor aesthetic design or location on roof surface), poor performance (e.g., due to product design, operation or location), costs, complexity of installation, etc.

Therefore, it is an object of the present invention to provide a roof spoiler device that creates a turbulent air flow on the roof surface to prevent wind damage. It is an additional object to provide a device that reduces the flow of air under the shingles. It is a further object to provide a roof spoiler device that has an acceptable aesthetic appearance. It is also an object to provide a roof spoiler device that may be used in conjunction with a roof gutter.

SUMMARY OF THE INVENTION

The present invention embraces a roof spoiler that effectively disrupts the attached flow of wind on a roof surface. Preferably, the spoiler is specially designed for installation at or near the roof fascia and, more preferably, will operate in conjunction with a gutter mounted on the roof fascia or along the leading edge of the roof. This spoiler utilizes a hinged design to move between two operating positions. The first position is a stowed position, whereby the spoiler is almost completely out of the view of passersby. In the stowed position, a portion of the spoiler covers the open gutter (if present), thereby creating a guard to help keep out leaves and other debris. A second portion of the spoiler may extend into the gutter.

The second position is a deployed position, wherein a barrier is projected vertically, or substantially vertically, so as to disrupt the flow of air over the roof surface. In one embodiment, the spoiler rests upon the first row of shingles when in the deployed position. In another embodiment, the spoiler rests near or against the fascia.

In one embodiment, the spoiler is L-shaped to facilitate its stability in the deployed position. The two members that comprise the L-shape may be of equal length, or may be of different lengths, as required.

DETAILED DESCRIPTION OF THE INVENTION

Figure 1A:
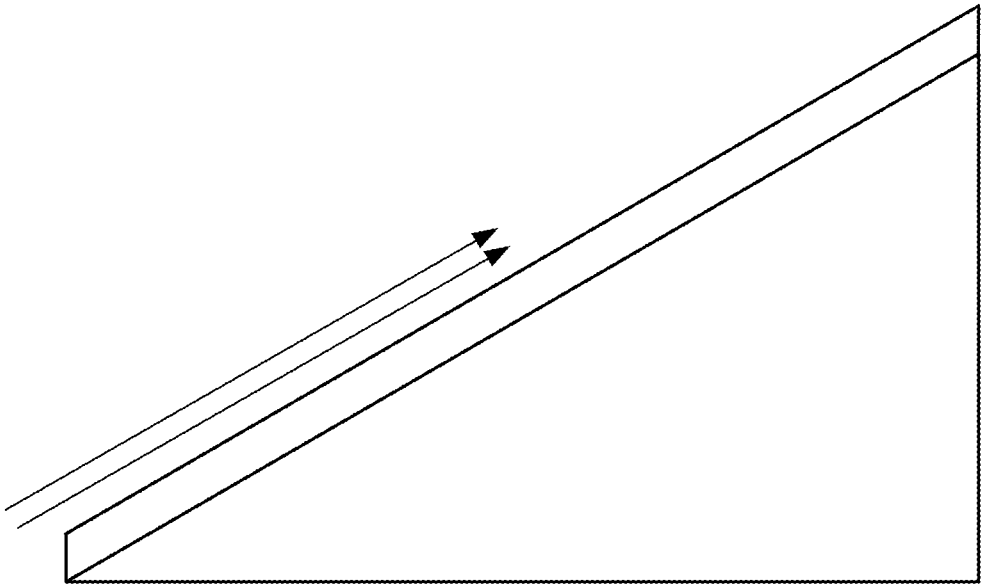
FIG. 1 depicts airflow over a roof surface with and without a roof spoiler.
Figure 1B:
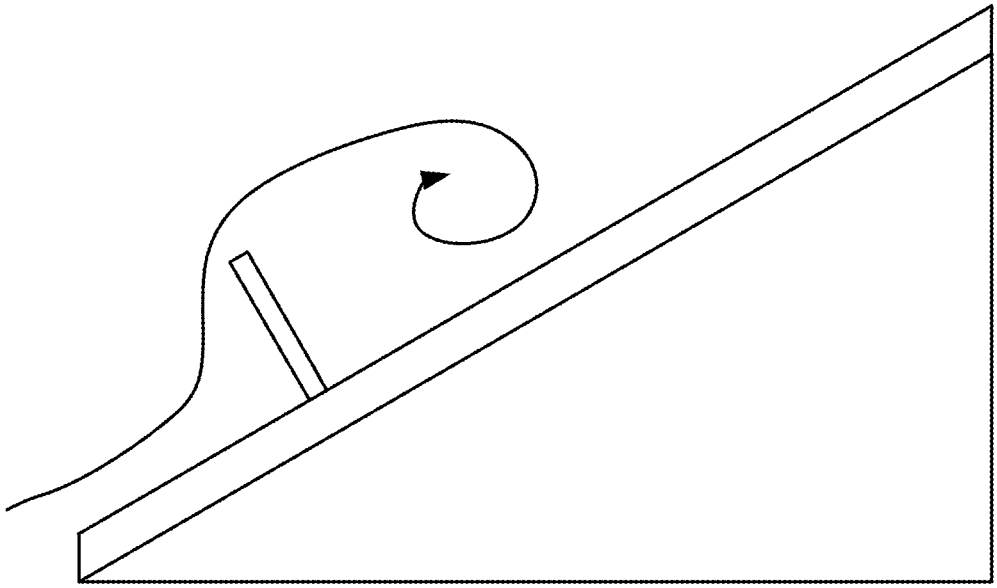

A roof spoiler is intended to present an obstacle to attached flow during high (e.g., hurricane-force) winds. One way to present such an obstacle is to introduce a vertical, or substantially vertical member that interrupts that air flow. In other embodiments, the obstacle may not be vertical, but rather orthogonal to the roof surface, as shown in FIG. 1*b*. However, as mentioned above, a vertical member attached to the roof surface is unsightly and not likely to be adopted.

To improve the aesthetics of a roof spoiler, it is preferable that the spoiler has at least two operating positions; a deployed position, where it acts as an obstruction as described above, and a stowed position, where the spoiler should be relatively non-intrusive and barely visible to passersby.

Figure 2:
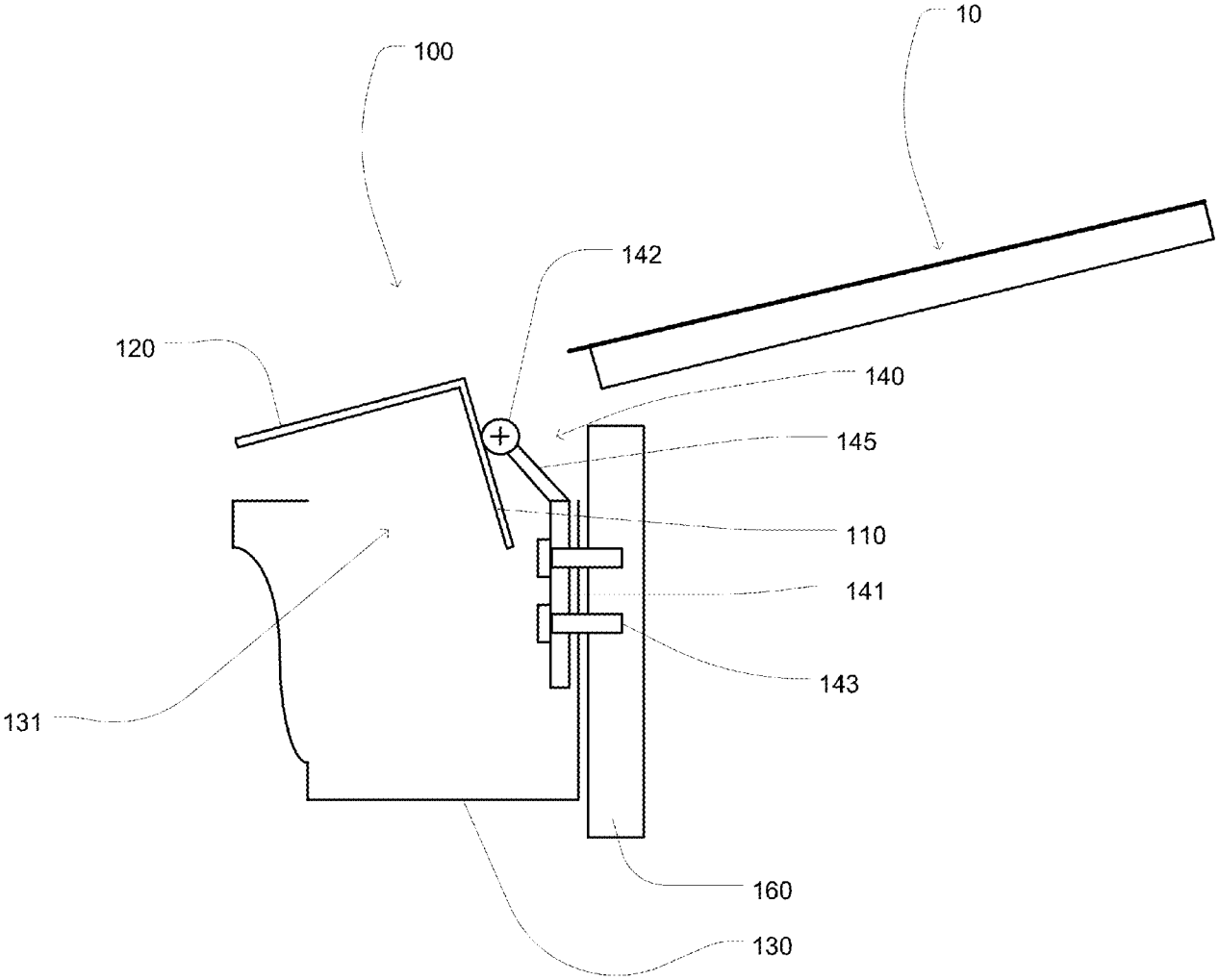
FIG. 2 depicts a cross-section of a first embodiment of a roof spoiler of the present invention, in the stowed position.

One embodiment of such a roof spoiler is depicted in FIG. 2, which shows a cross-section of a first embodiment of the roof spoiler in the stowed position. The roof spoiler 100 is preferably L-shaped, with two roughly orthogonal members; a first member 110 and a second member 120. Each member has a length (i.e., the short dimension that extends away from the roof edge) and a width (i.e., the long dimension parallel to the roof edge) and preferably is substantially planar. In the stowed position, the first member 110 is disposed in an approximately vertical orientation, extending downwardly toward the inside of the gutter 130 (if a gutter is desired and present). In some embodiments, the first member may be disposed orthogonal (i.e., at approximately a 90° angle) to the roof surface. This first member 110 can be any suitable length, such as 5 cm to 30 cm, preferably about 10 cm to 23 cm. However, it is preferably shorter than the depth of the gutter. In addition, it is preferably shorter than the width of the gutter opening, as will be explained later.

The second member 120 is disposed in an approximately horizontal orientation, extending away from the edge of roof 10. In some embodiments, such as the one shown in FIG. 2, the second member may be parallel to the roof surface (i.e., the plane of the roof). The second member may also be coplanar with the roof surface, such that it appears to be an extension of the roof. In these embodiments, the second member may extend from the vertical direction at an angle from about 60° to about 90°, depending on the slope of the roof. In the stowed position, the second member 120 covers a portion, and in some embodiments, all, of the gutter opening 131 (if a gutter is desired and present). In this way, the gutter 130 is protected from leaves and other debris that can enter the gutter 130 and subsequently clog it, thereby preventing proper operation. The second member 120 can be of any suitable length, such as 10 cm to 46 cm, preferably about 15 cm to 30 cm, and that length is not constrained by the depth or width of the gutter 130. In other words, the width and depth of the gutter opening have no effect on the length of the second member 120. This flexibility is critical in that the length of the second member 120 determines the height of the spoiler in the deployed position. Thus, the spoiler can be made arbitrarily long without impacting its operation in the stowed position. Furthermore, the length of the second member 120 is not apparent to passersby. Therefore, it is possible to implement a tall obstacle (when in the deployed position), without creating an unsightly apparatus on the roof.

The members 110, 120 are constructed from a durable material, such as metal, alloys, composites, plastics (such as PVC and ABS), polymers, polymer composites, and building materials, such as wood or wood composites, cement, or cemtitious boards. Factors such as strength, durability, ultraviolet and corrosion resistance, manufacturability and cost may be used to select an appropriate material. In some embodiments, the two members are formed as a unitary piece, which is preferably extruded to reduce cost. In some embodiments, the two members are the same thickness, while in other embodiments, the thicknesses of the two members differ. The thickness of each member is determined based on the material used and the desired durability and rigidity of that member.

Figure 20A:
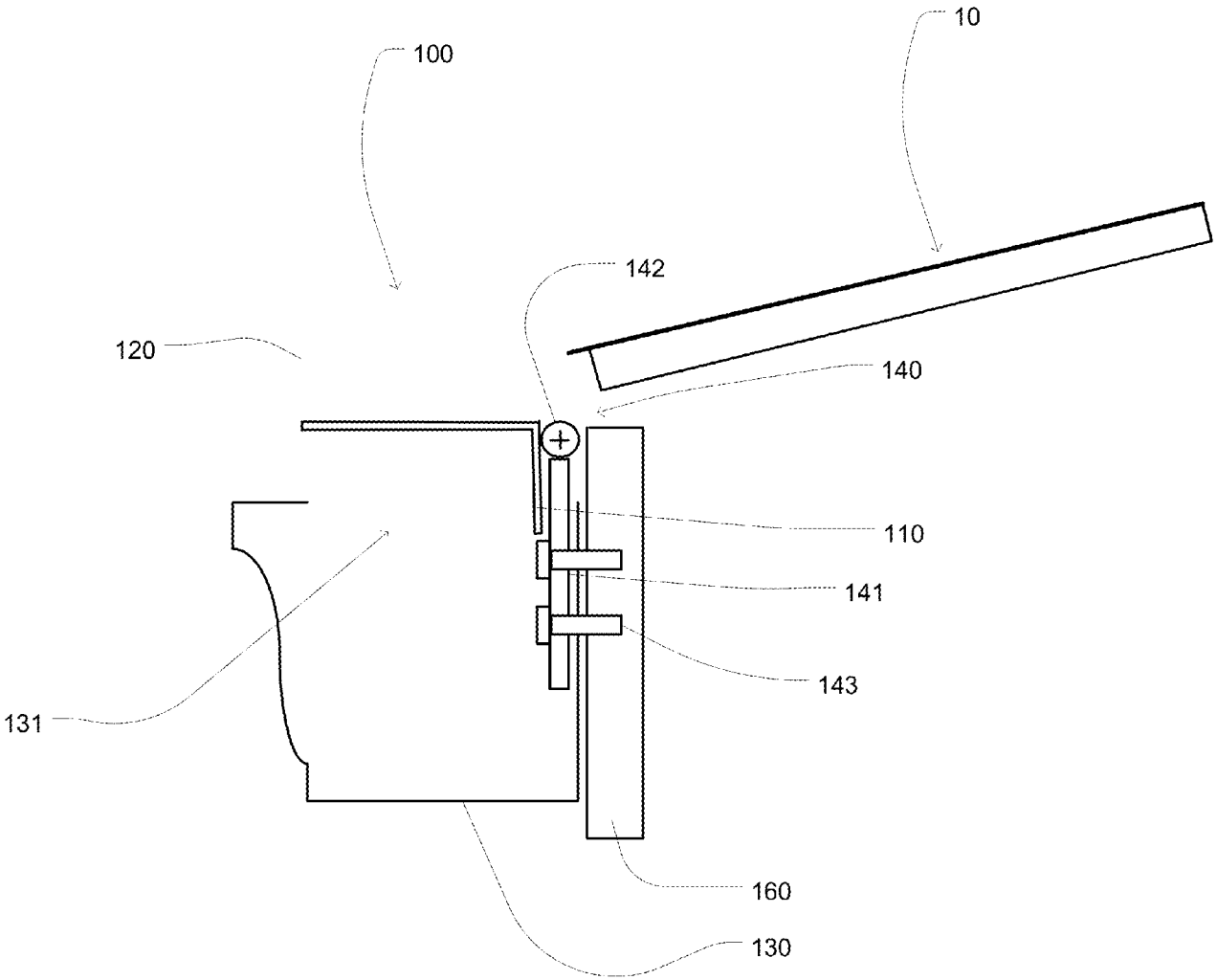
FIG. 20*a-b* show several modifications to the spoiler of FIG. 2 in the stowed position.
Figure 20B:
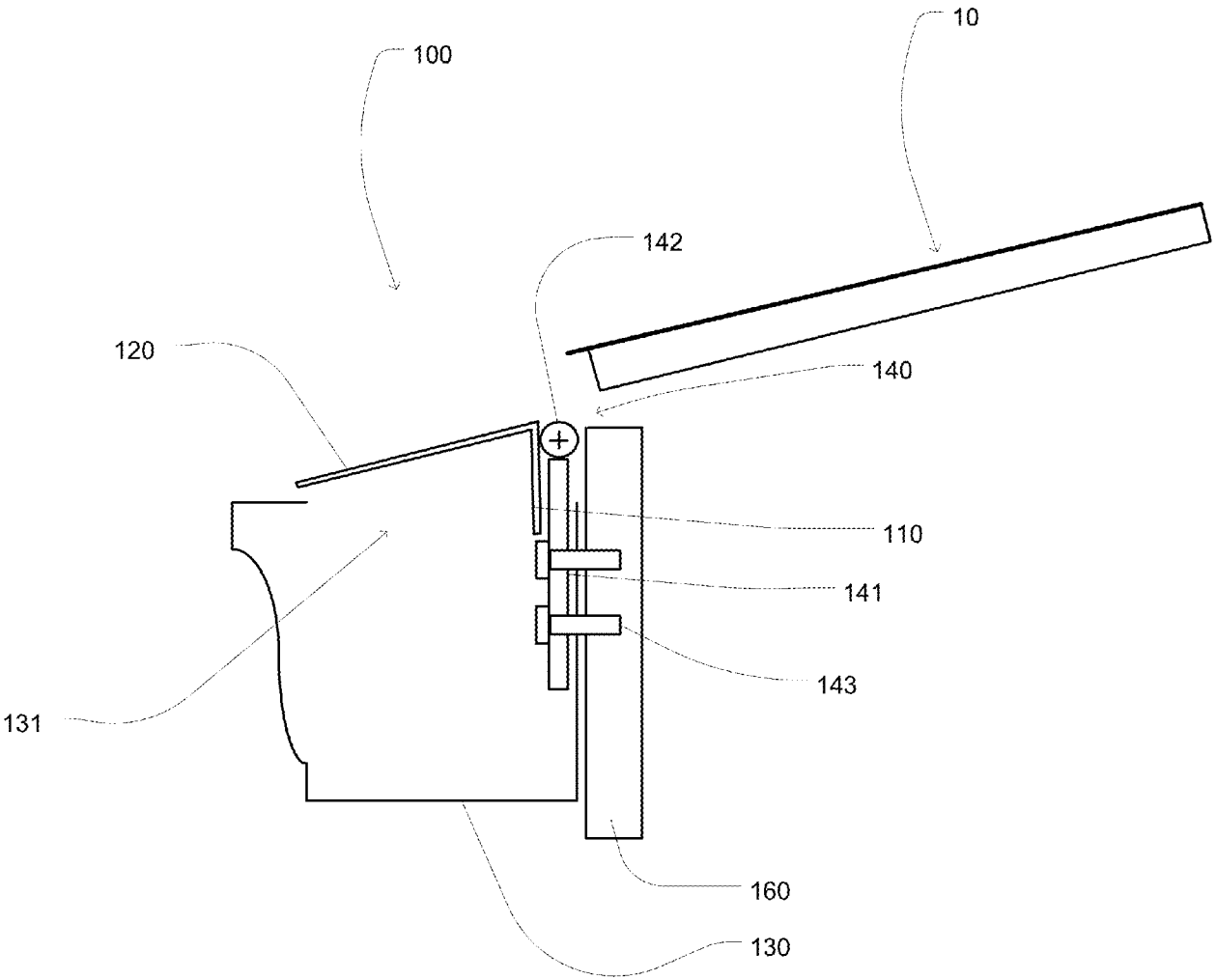

The roof spoiler 100 is in communication with a pivoting mechanism 140, such as a hinge. The roof spoiler 100 is configured to operate with the pivoting mechanism 140 such that it rotates from about 75° to about 125°, preferably about 80° to about 110°, more preferably about ninety degrees) (90°, between its stowed position and its deployed position. In some embodiments, the pivoting mechanism is a simple hinge, such as shown in FIG. 2. In this embodiment, the pivoting mechanism has a first portion, or bracket 141, which is affixed to the roof fascia 160, using fasteners 143, such as nails or screws. In general, the bracket 141 is oriented in the vertical direction, as shown in FIG. 2. If necessary, standoffs may be used to insure that the bracket 141 is sufficiently spaced apart from the gutter and fascia 160. As will be described in more detail below, stops may be used to limit the rotation of the pivoting mechanism. The pivoting mechanism 140 also has a second slanted portion 145, at an angle relative to the bracket 141, so as to move the axis of rotation (i.e. pivoting connection 142) a distance away from the fascia 160. In some embodiments, the distance from the axis of rotation (pivoting connection 142) to the edge of the roof is less than the length of the first member 110. In some embodiments, the pivoting mechanism 140 is connected to the first member 110 at a location between its two ends. By moving the axis of rotation, or pivoting connection 142 away from the fascia 160, the first member 110 may be disposed in an orientation that allows the second member 120 to be parallel to the roof surface. In other words, the first member 110 can move past vertical in the stowed position. For example, the first member 110 shown in FIG. 2 rotates past the vertical direction. In some embodiments, the first and second members are orthogonal to one another, and the first member 110 is disposed at such an angle so that the second member 120 is coplanar with the surface of the roof. Therefore, if the surface of the roof has an angle of θ° with respect to the horizontal plane, second member 120 may also have this angle. If the two members are orthogonal, the first member 110 must move past vertical by θ° as well. In this case, the second member 120 extends at an angle of (90-θ)° from the bracket. In these embodiments, the second member 120 extend outwardly from the bracket 141 at an angle of about 60° to about 90° in the stowed position, depending on the slope of the roof surface. Therefore, pivoting connection 142 must be placed at a location so as to allow the first member 110 this degree of rotation. Note that if the axis of rotation (pivoting connection 142) remains at the fascia, the first member 110 cannot rotate past vertical. However, in some embodiments, the axis of rotation or pivoting connection 142 may be located near the fascia 160, recognizing that the rotation of the spoiler may be limited in this configuration. FIG. 20*a* shows a spoiler in which the axis of rotation or pivoting connection 142 is at or near the fascia 160. In this embodiment, the second member 120 is roughly orthogonal to the fascia 160, due to the inability of the first member 110 to move past the vertical orientation. In FIG. 20*b*, the first and second members are configured at an angle less than 90 degrees, to allow the second member 120 to be parallel to the roof surface when in the stowed position. In these embodiments, the angle between the first and second members may be from about 60° to 90°, depending on the slope of the roof. In other embodiments, the first and second members are configured at an angle greater than 90°, such as between 90° and 120°. Thus, the first and second members may meet at an angle between 60° and 120°, preferably between 80° and 100°, more preferably at 90°.

Figure 3:
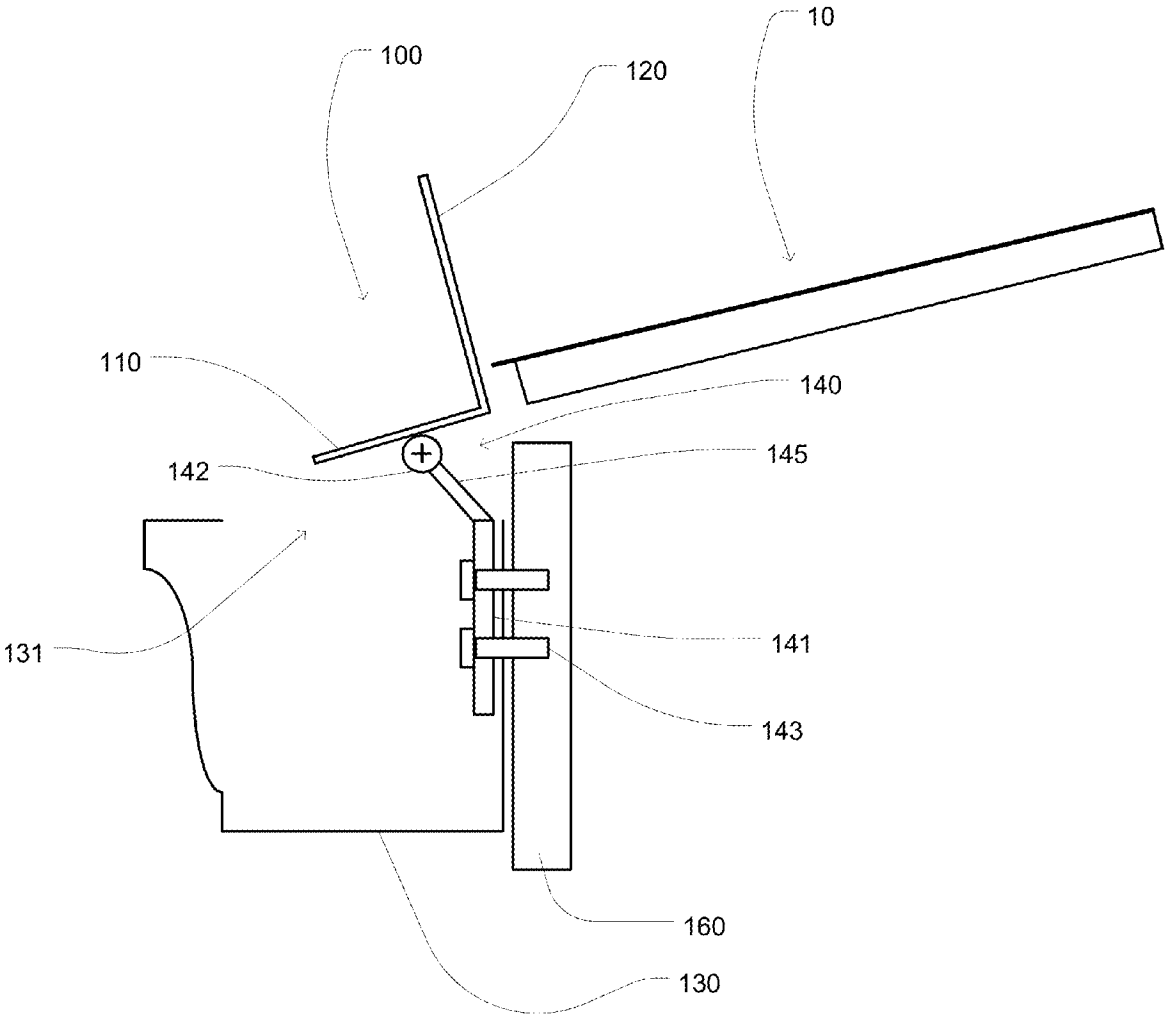
FIG. 3 depicts the roof spoiler of FIG. 2 in the deployed position.

FIG. 3 shows the spoiler of FIG. 2 in the deployed position. In the presence of high speed winds, the wind will force the spoiler to rotate from its stowed position (shown in FIG. 2) to its deployed position. The constant air flow will force the spoiler to remain in its deployed position. When the wind has stopped, or sufficiently slowed, gravity will then urge the spoiler 100 back to its stowed position.

In the deployed position, the second member 120 is disposed in a vertical, or substantially vertical orientation. In some embodiments, the second member is not vertical, but rather is orthogonal (i.e., at approximately a 90° angle) to the plane of the roof surface, as shown in FIG. 3. In other words, the second member 120 may be at an 180° angle with respect to the bracket 141, if it is disposed in a vertical orientation. However, if the second member 120 is oriented to be orthogonal to the roof surface, the angle between the bracket 141 and the second member 120 will be less than 180°, such as between 140° and 180°, depending on the slope of the roof. In some embodiments, the rotation of the spoiler 100 is stopped when the second member 120 comes into contact with the edge of roof 10. In other embodiments, the second member 120 may contact the fascia 160 in the deployed position. In other embodiments, a stop may be used to limit the rotation of the spoiler 100.

Figure 21A:
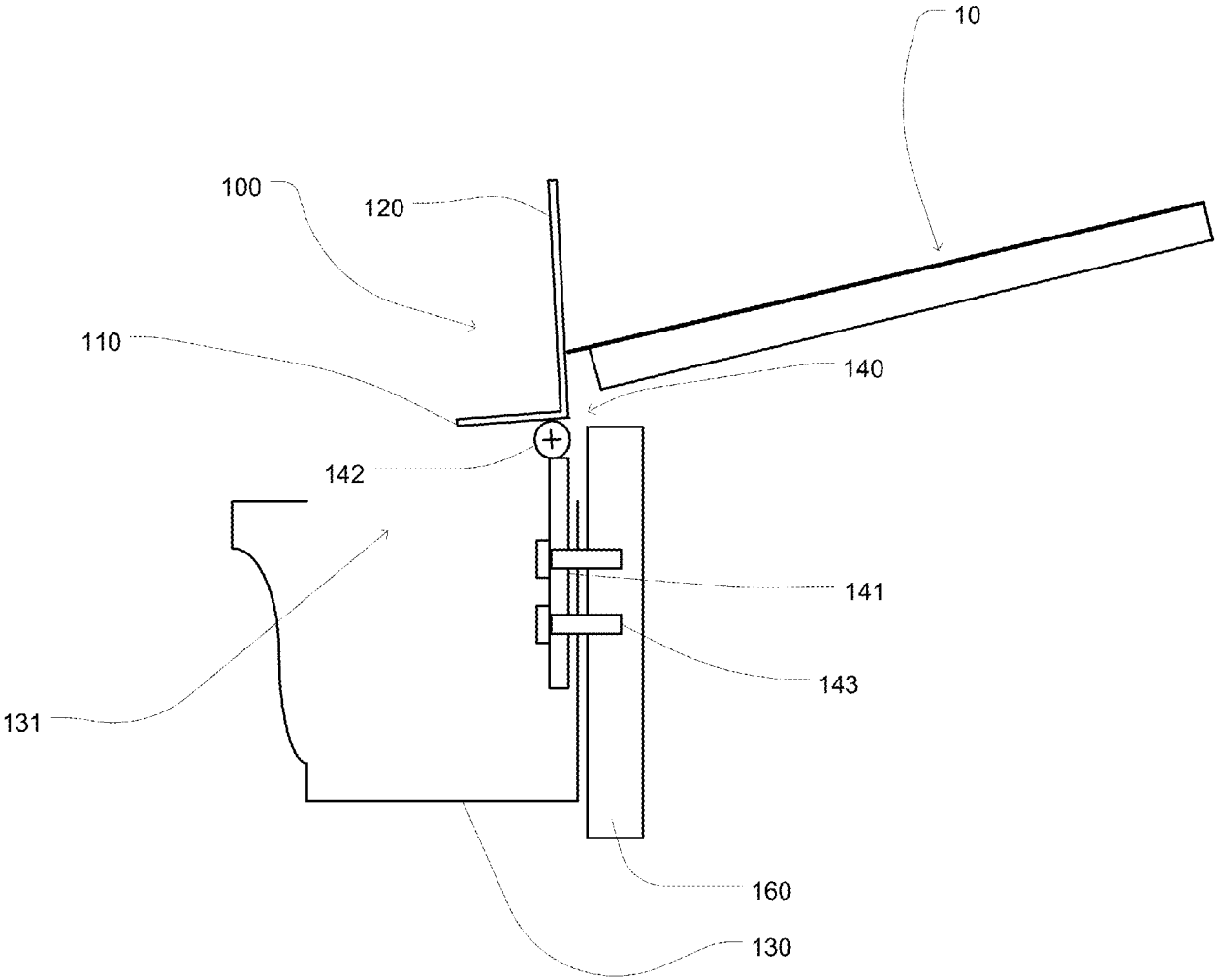
FIG. 21*a-b* show the spoilers of FIG. 20*a-b* in the deployed position.
Figure 21B:
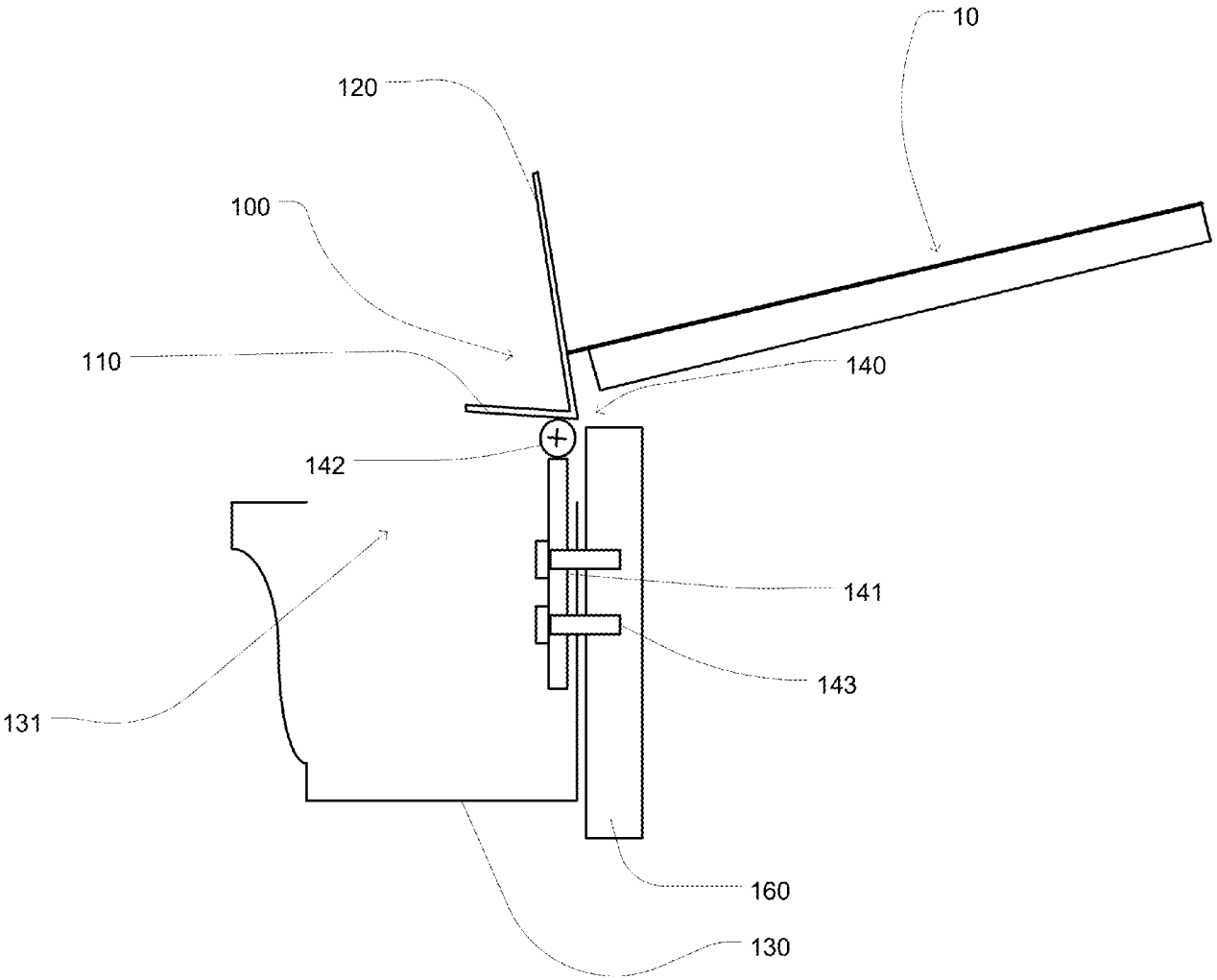

FIG. 21*a* shows the spoiler of FIG. 20*a* in the deployed position. FIG. 21*b* shows the spoiler of FIG. 20*b* in the deployed position.

Figure 4:
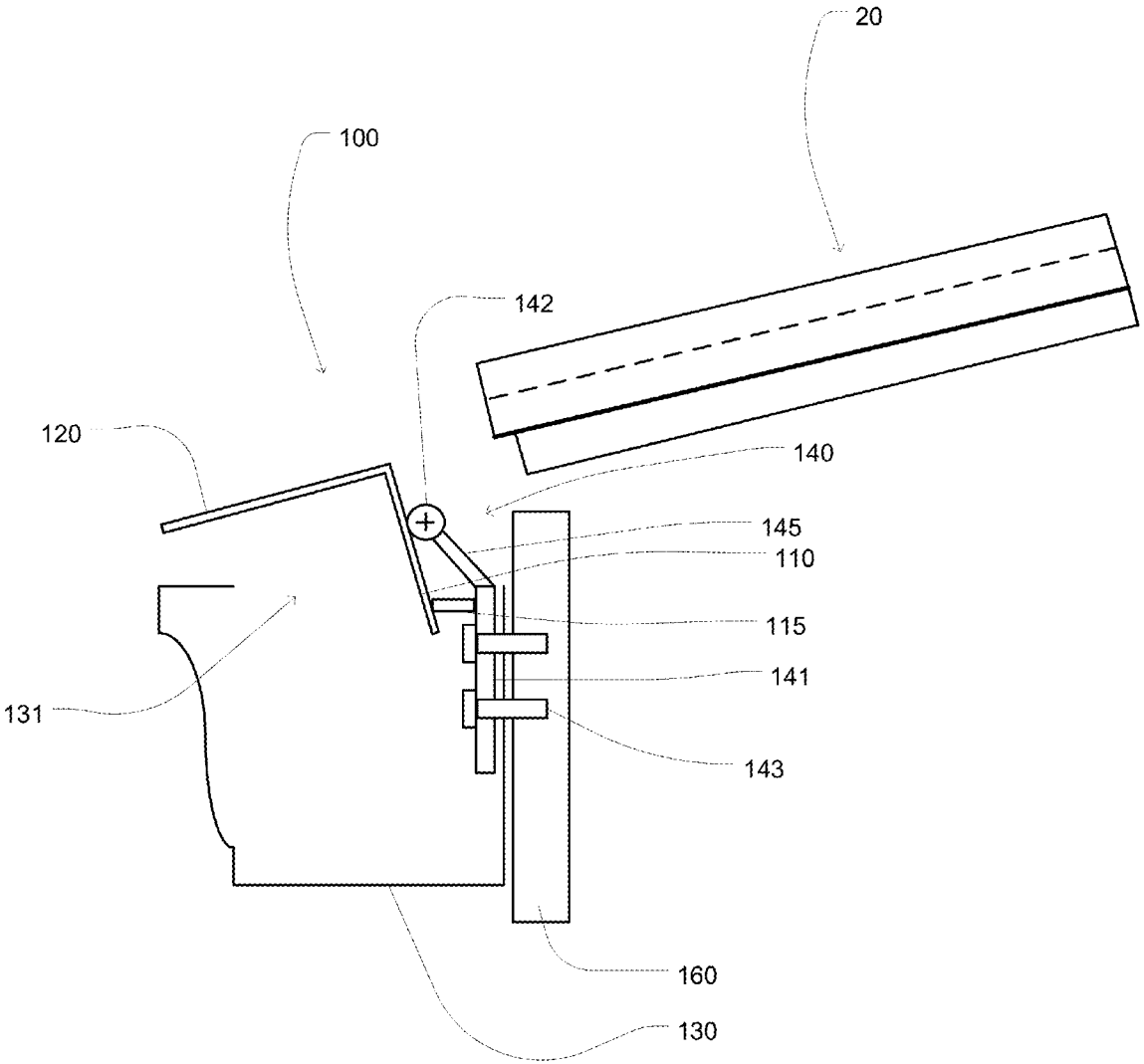
FIG. 4 depicts a cross-section of a first embodiment of a roof spoiler of the present invention used with a tile roof, in the stowed position.

These embodiments are advantageous in that they function with roofs of varying thicknesses. For example, FIG. 4 shows the roof spoiler of FIG. 2, in its stowed position, used with a tile roof 20, where the thickness of the tile roof is many times greater than that of a typical shingled roof. In the embodiment shown in FIG. 4, the second member 120 of the spoiler 100 in the stowed position does not lie in the same plane as the top of the tile roof. However, this is not necessarily a limitation of this design, as the spoiler can be modified so that the second member 120 lies in the same plane as the tile roof 20. If desired, this can be done by varying the height of the bracket 141 or the second slanted portion 145, changing the angle between the bracket 141 of the hinge and the second slanted portion 145 of the pivoting mechanism 140, or changing the point on the first member 110 where it contacts the pivoting connection 142. Each of these modifications will be apparent to a skilled engineer and need not be described further.

Figure 5:
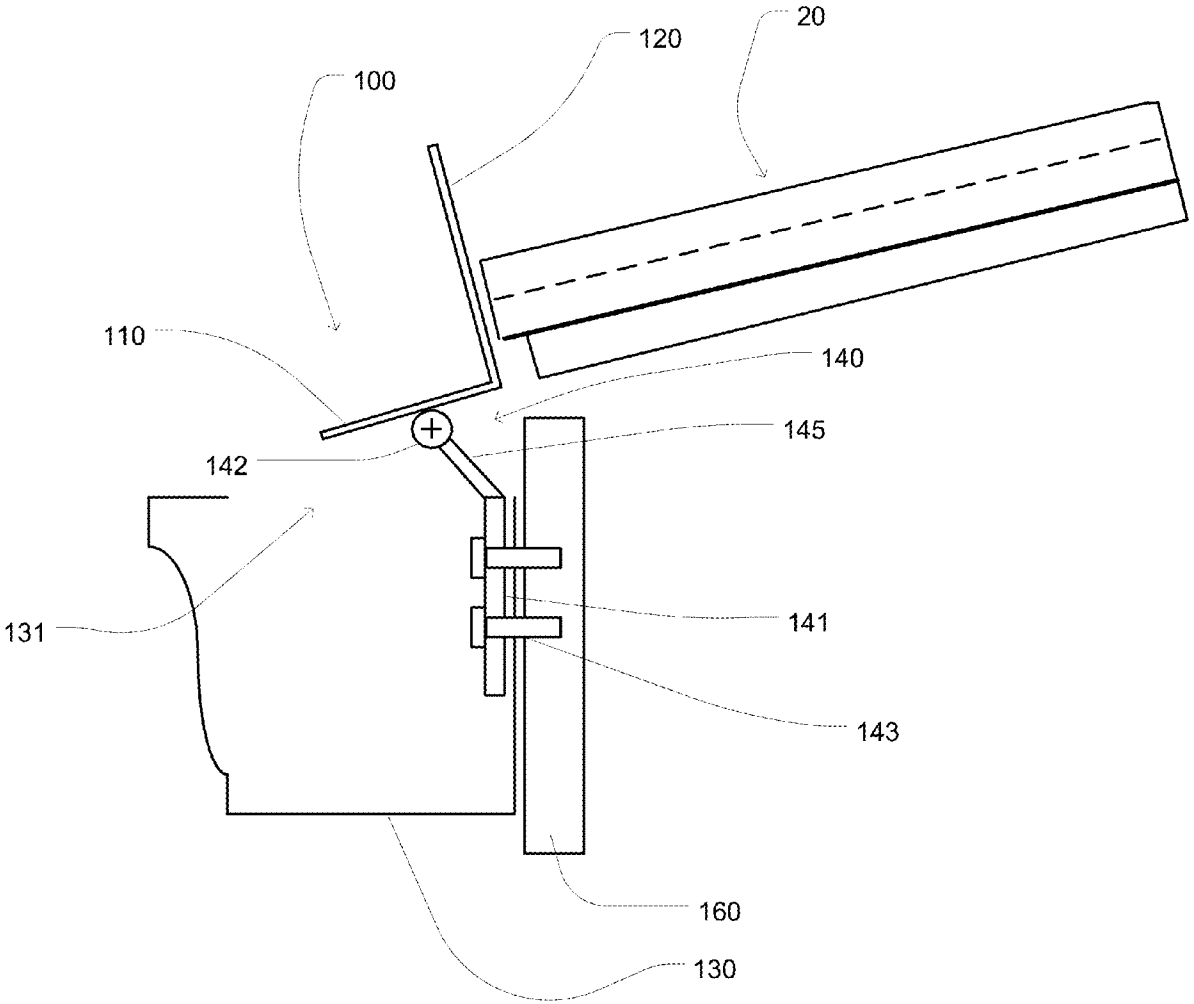
FIG. 5 depicts the roof spoiler of FIG. 4 in the deployed position.

FIG. 5 shows the spoiler in the deployed position with a tile roof 20. In this figure, the spoiler 100 does not extend as far above the roof 20, as the previous embodiment, shown in FIG. 3, due to the increased thickness of the roof. However, this can also be modified, if desired, such as by raising the height of the bracket 141, or second slanted portion 145. Additionally, this can be compensated for by extending the length of the second member 120 such that it extends a sufficient height above the tile.

In some embodiments, such as those shown in FIG. 2-5, the range of motion of the roof spoiler 100 is limited in one direction by the gutter 130, and by the edge of the roof in the opposite direction. FIG. 4 shows a stop, or standoff, 115, which can be used to limit the rotation of the spoiler 100 in the stowed position. In the illustrated embodiment, the stop 115 is used to keep the second member 120 from contacting the gutter 130. Furthermore, the stop 115 can be used to create a stowed position, wherein the second member 120 lies in the same plane as the roof surface. This provides visual continuity, such that the second member 120 appears as an extension of the roof surface. In other embodiments, the stop 115 may use a different mechanism. For example, the pivoting mechanism 140 may be designed to have limited rotation, thereby creating the required stop.

Another advantage of this embodiment is its ability to stop the flow of wind into the tile roof 20. In many tile roofs, the tile is constructed in a wavy or sinusoidal type pattern. When the tile is applied to the roof, there are gaps between the tile and the underlying roof, as a result of the tile's shape. During hurricanes, wind can enter these gaps, and force the tile away from the roof. In the deployed position shown in FIG. 5, the roof spoiler 100, and particularly second member 120, also serves to block the open ends of tile from incoming wind, thereby eliminating another cause of roof damage.

Figure 6:
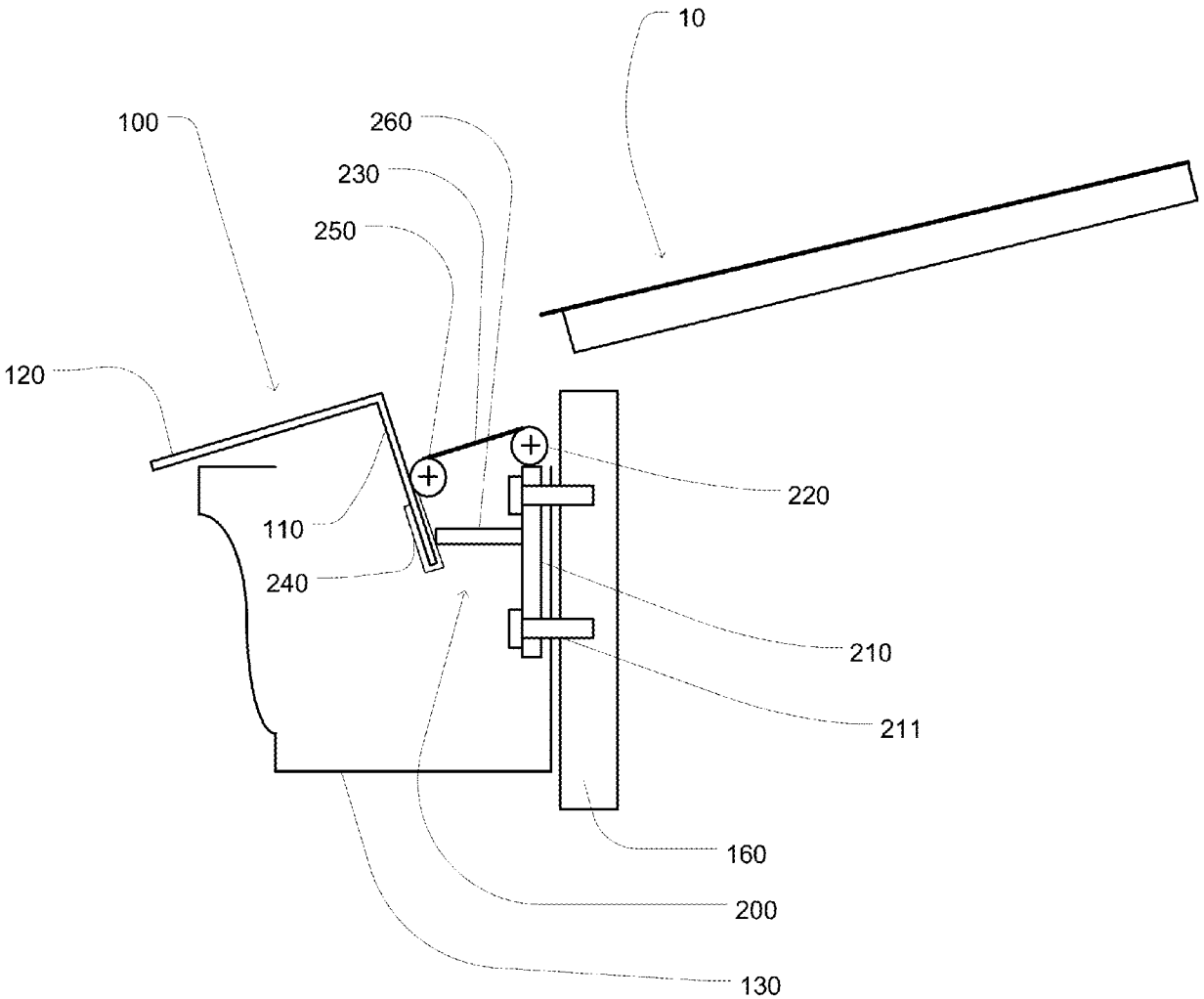
FIG. 6 depicts a cross-section of a second embodiment of a roof spoiler of the present invention, in the stowed position.

In another embodiment, shown in FIG. 6, the pivoting mechanism 200 includes several components. A bracket 210 is affixed to the fascia 160, such as by fasteners 211, such as screws or nails. One or more of the fasteners 211 may pass through the gutter 130 (if present), further securing it to the fascia 160. Near the upper end of the bracket 210 is a first pivot 220. Attached to this pivot 220 is an extension rod 230, the opposite end of which connects to the spoiler holder 240. In some embodiments, the extension rod 230 is joined to the spoiler holder 240 via a second pivot 250. However, in other embodiments, this joint 250 is fixed and cannot rotate. In other embodiments, the extension rod 230 is attached directly to the first member 110. Extension rod 230 may be any suitable shape. In some embodiments, it is a bracket, which connects first pivot 220 to second pivot 250 (see FIG. 14). In other embodiments, it may be a solid material, extending the length of the spoiler 100. For example, the extension rod 230 may be constructed from the same material as the spoiler 100.

This embodiment also shows spoiler holder 240 being used to hold first member 110. However, other embodiments are possible as well. For example, the second pivot 250 may be affixed directly to the first member 110. The spoiler holder 240 allows the manufacture of the spoiler to be simplified, but is not required in the present invention.

Figure 8:
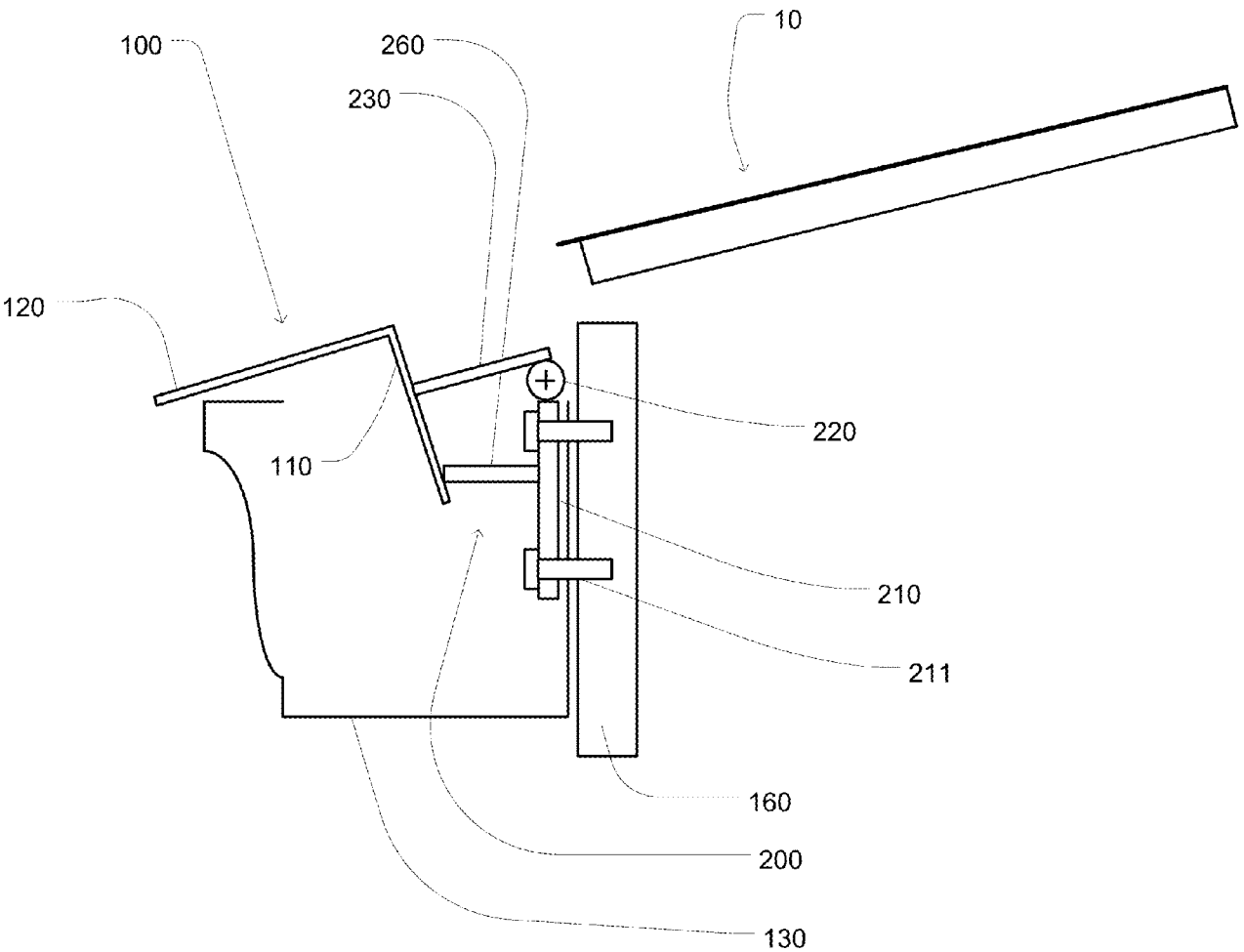
FIG. 8 depicts a cross-section of a third embodiment of a roof spoiler of the present invention, in the stowed position.

In other embodiments, extension rod 230 is an integral part of spoiler 100. FIG. 8 shows an embodiment of the spoiler in which the extension rod is a part of first member 110. In this embodiment, first pivot 220 connects to the base of extension rod 230. In some embodiments, first member 110, second member 120 and extension rod 230 are formed (e.g., extruded or molded) as a single part.

Additionally, the bracket 210 may also include a stop 260, which contacts the first member 110 or the spoiler holder 240, when the spoiler 100 is in the stowed position. The stop 260 determines the extent of the rotation of the pivoting mechanism 200 in the stowed position. As can be seen in FIG. 6, the stop 260 may be set so that the second member 120 is substantially parallel to the surface of the roof 10 in the stowed position. It may also be necessary to set the stop 260 so that the second member 120 does not touch the outer edge of the gutter 130. In some embodiments, the pivoting mechanism 200 is configured such that the second member 120 is parallel to the roof 10 in the stowed position. In other embodiments, a stop is not used, and the rotation of the spoiler is limited by the gutter 130.

Figure 7:
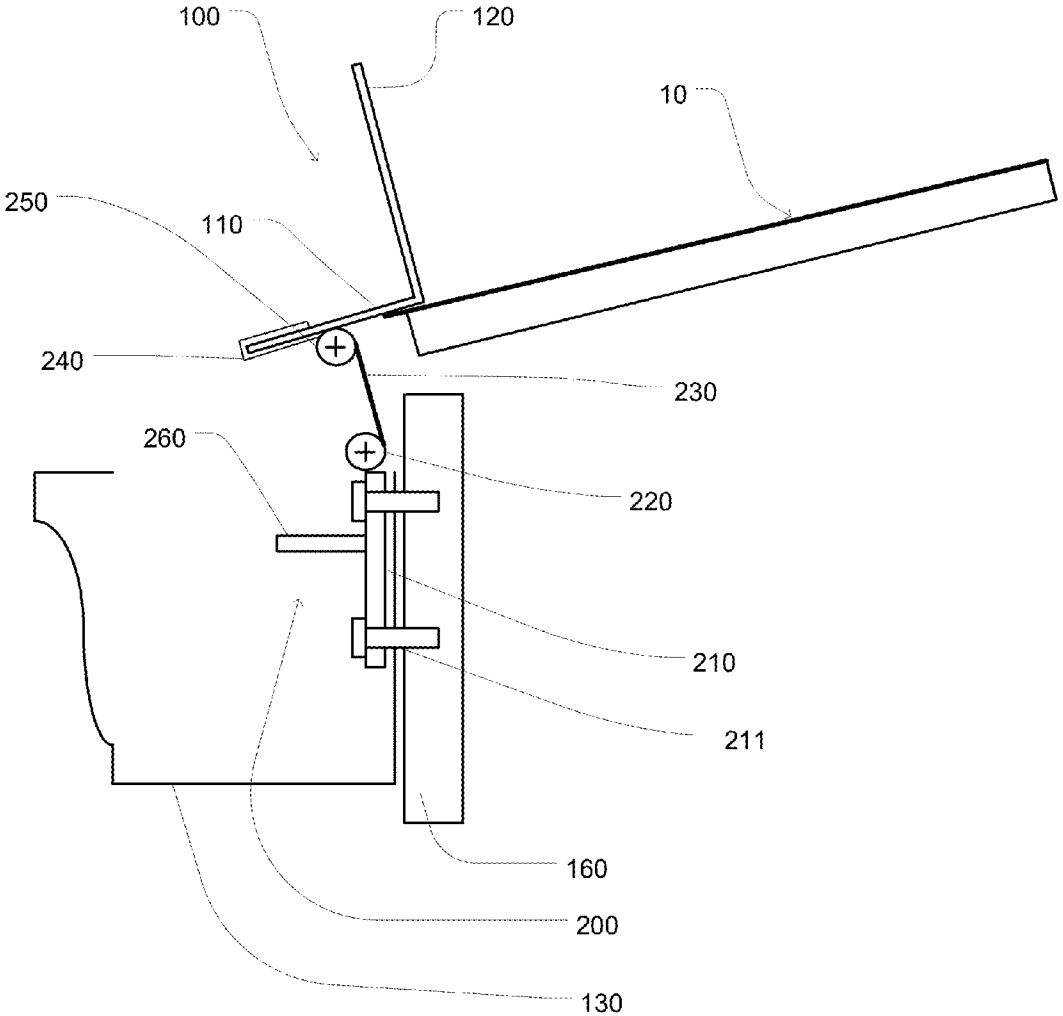
FIG. 7 depicts the roof spoiler of FIG. 6 in the deployed position.

FIG. 7 shows the spoiler of FIG. 6 in the deployed position. The extension rod 230 is preferably sized such that a portion of first member 110 rests on top of a portion of the roof 10 when deployed. This configuration has several benefits. First, the roof provides a stop in the deployed direction for the pivoting mechanism. Second, the spoiler 100 serves to urge the front row of shingles downward due to the pressure exerted by the wind. The configuration of the extension rod 230 and the first member 110 may determine the size of the portion of the first member 110 that sits upon the roof 10. In some embodiments, such as is shown in FIG. 7, only a small portion of the first member 110 is on the roof 10. However, in other embodiments, the parts can be configured such that a larger portion of the first member 110 rests on the roof 10.

When the wind ceases, the spoiler 100 returns to its stowed position, through the force of gravity. If desired, the spoiler can be urged toward the stowed position, through the use of a biasing element, such as a spring in first pivot 220.

Figure 9:
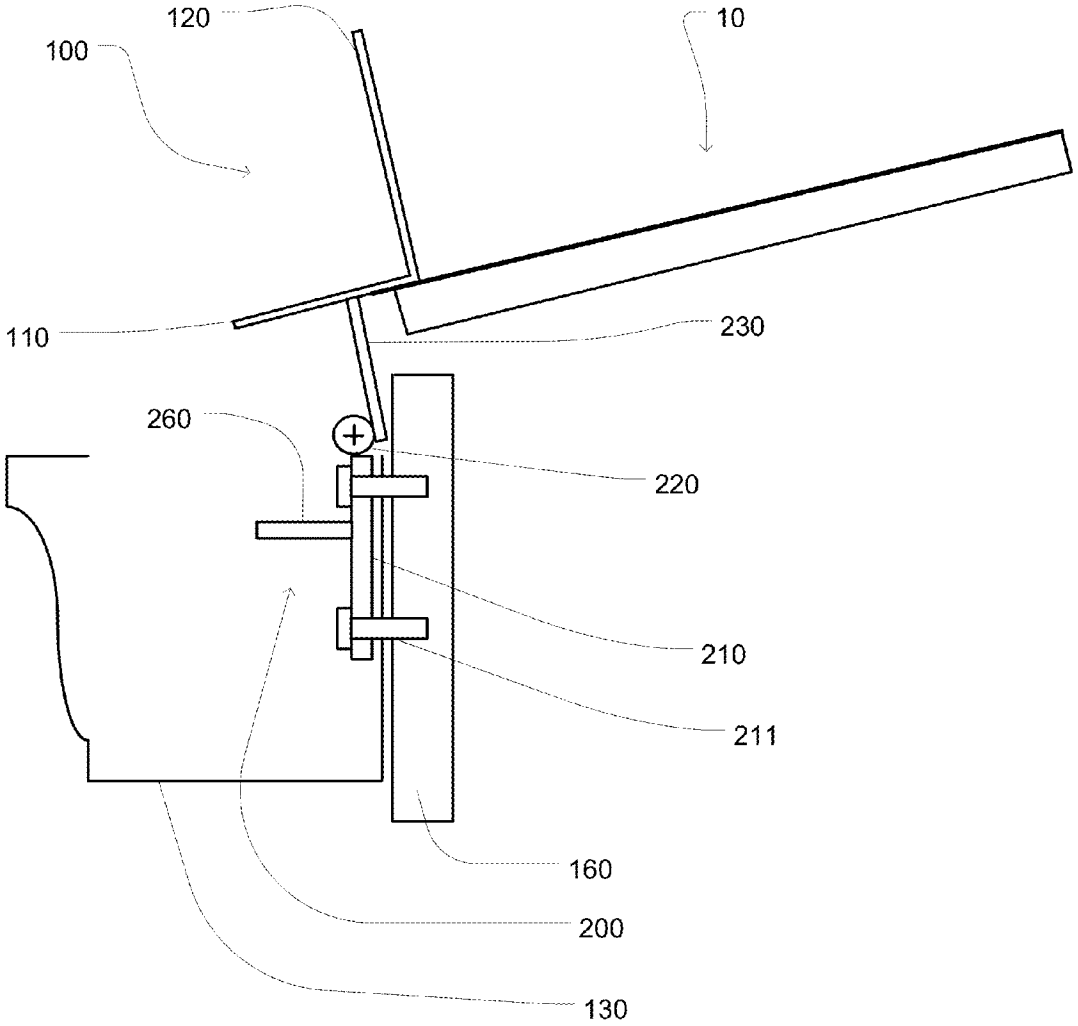
FIG. 9 depicts the roof spoiler of FIG. 8 in the deployed position.

FIG. 9 shows the spoiler of FIG. 8 in the deployed position. As with FIG. 7, a portion of the spoiler 100 preferably sits on top of a portion of the roof 10. In some embodiments, extension rod 230 is integral with first member 110 and extends the entire length of the spoiler. In such embodiments, the extension rod 230 may also serve as a wind guard, blocking the flow of air between the roof and the shingle.

Figure 10:
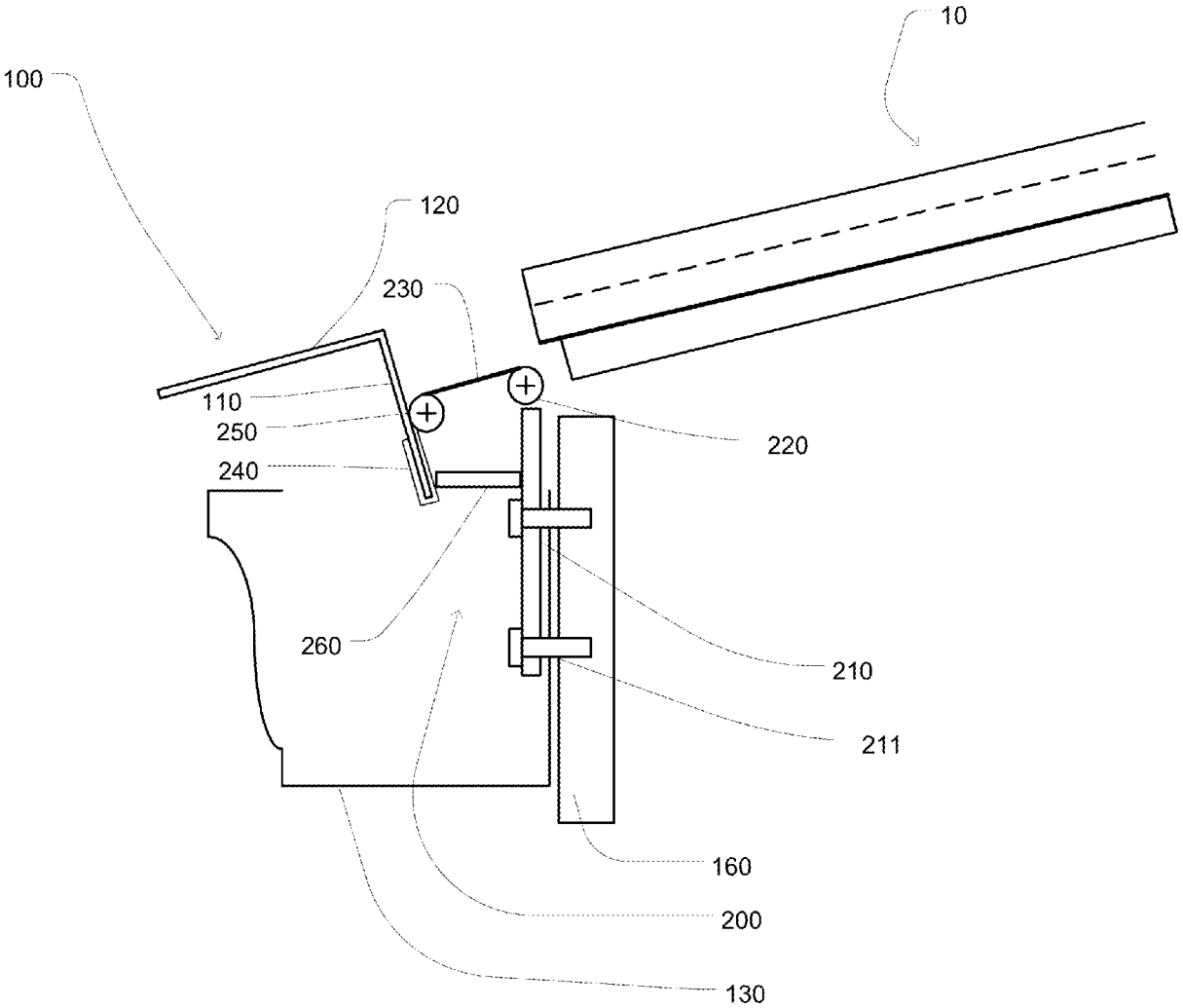
FIG. 10 depicts the roof spoiler of FIG. 6 used in conjunction with a tile roof.

FIG. 10 depicts the spoiler of FIG. 6 used in conjunction with a taller roof, such as one made of tiles. In this embodiment, bracket 210 has been lengthened or adjusted so as to move the pivot 220 closer to the top of the roof 20. Alternatively, extension rod 230 may be lengthened to provide a similar effect.

Figure 11:
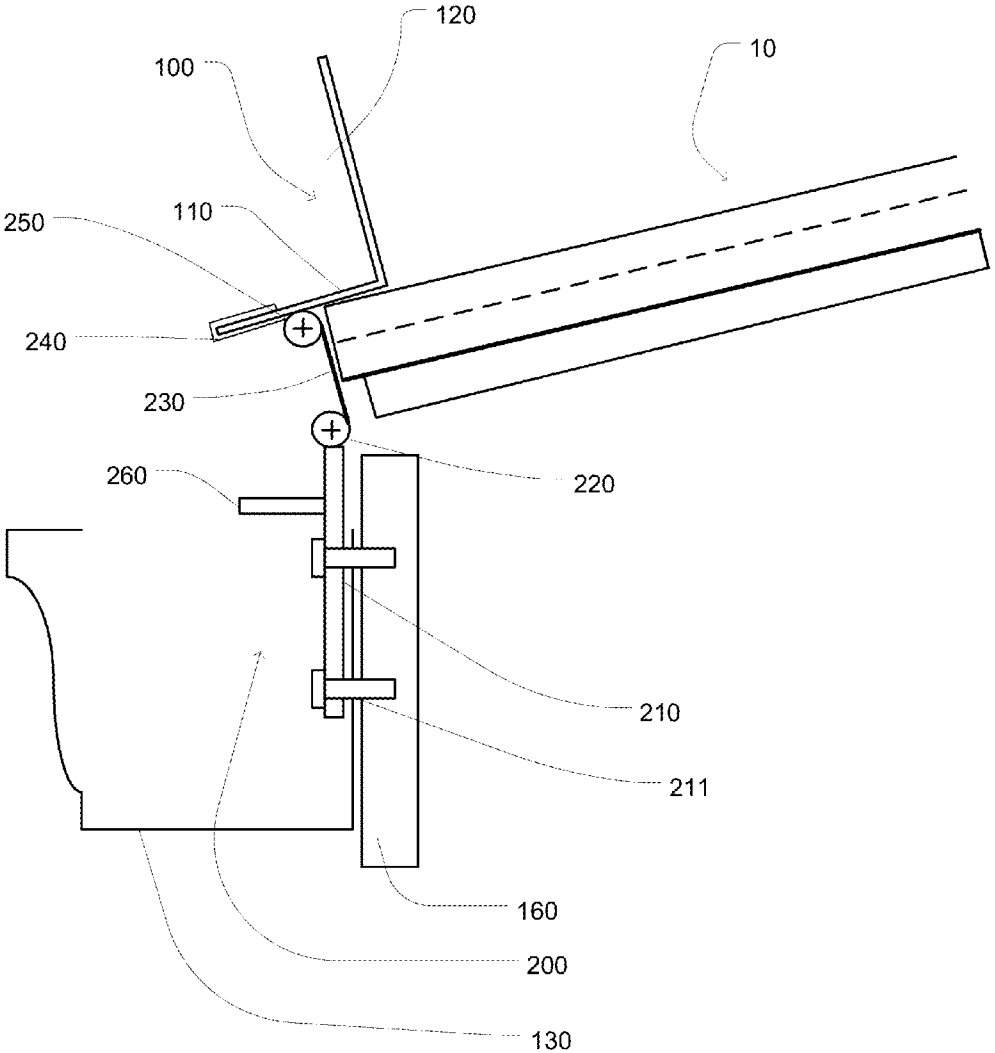
FIG. 11 depicts the roof spoiler of FIG. 10 in the deployed position.

FIG. 11 shows the spoiler of FIG. 10 in the deployed position. Note that in this embodiment, in contrast to the embodiment of FIG. 5, the spoiler 100 does not block the gaps under the tiles. Rather the extension rod 230 is positioned in this area. If the extension rod 230 is a solid piece, as described above with respect to FIG. 9, the extension rod 230 may serve as a wind guard. However, in other embodiments, the extension rod 230 may be a smaller piece, used to join the first pivot 220 to second pivot 250. In these embodiments, wind may blow between the shingle and the roof, especially in the case of tile.

Figure 12:
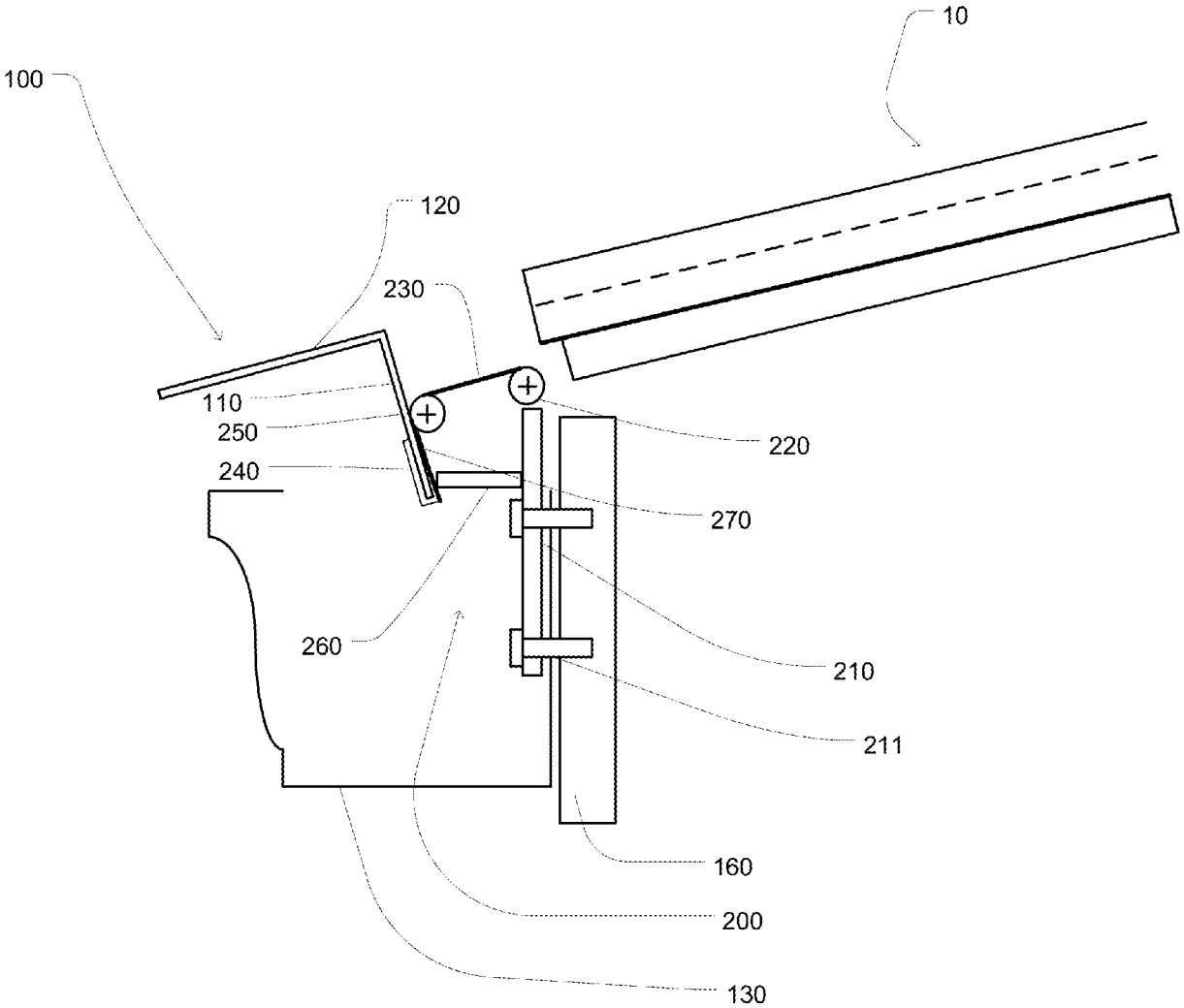
FIG. 12 depicts the roof spoiler of FIG. 10 in the stowed position with a wind guard.
Figure 13:
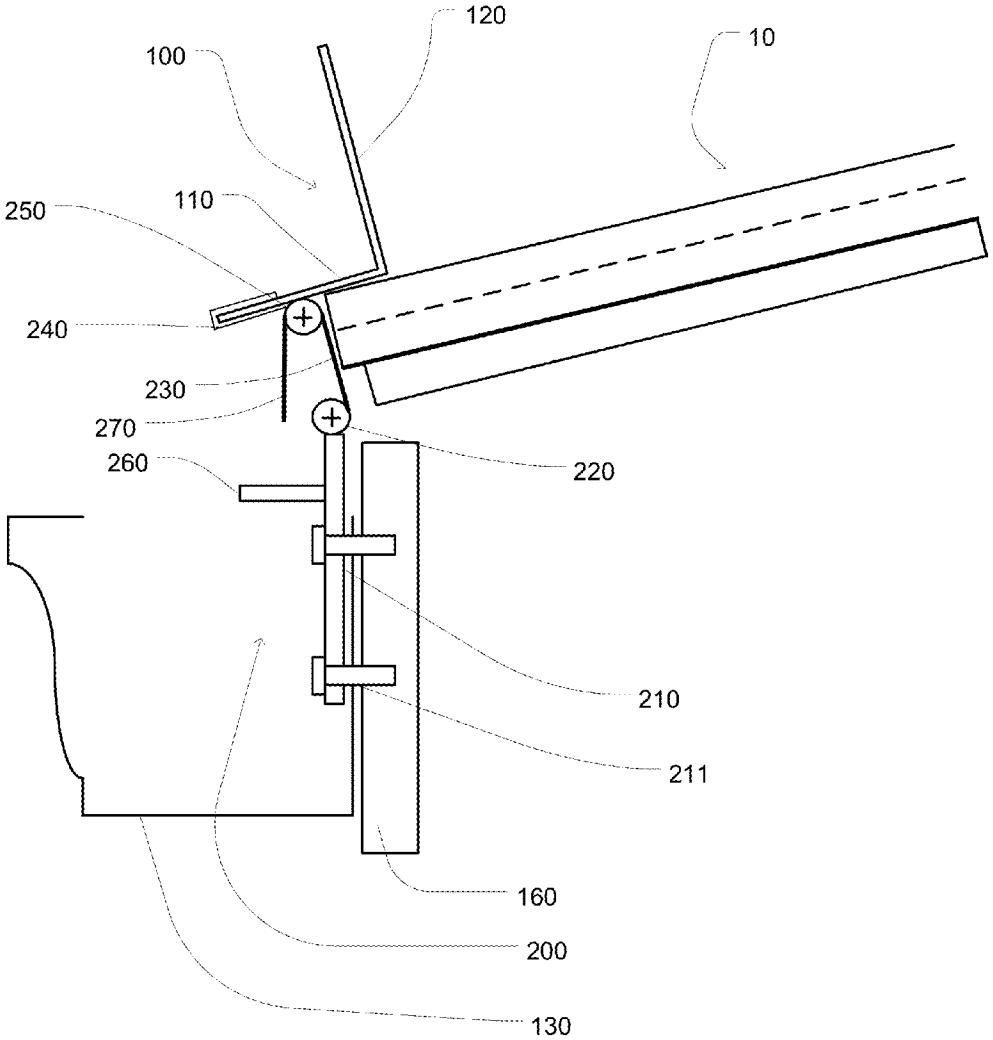
FIG. 13 depicts the roof spoiler of FIG. 12 in the deployed position.

To prevent wind from blowing under the shingle, a wind guard 270, as shown in FIGS. 12 and 13, may be included. The wind guard 270 is rotatably attached to pivot 250, such that it is free to rotate. In the stowed position, the wind guard 270 is pressed between the first member 110 and the stop 260. In the deployed position, the wind guard 270 hangs down, such that it blocks the gap between the roof and the shingle or tile, as shown in FIG. 13. Wind would tend to push the wind guard 270 toward the roof, where it would serve to block wind from entering under the tiles. The wind guard 270 also serves to insure that air does not pass between the spoiler 100 and the roof. A gap between the spoiler 100 and the roof serves as a path for wind, which accelerates through the gap. This may significantly degrade the performance of the spoiler. Wind guard 270 may be used to improve the performance of the spoiler 100 by eliminating the gap between the spoiler 100 and the roof.

Other embodiments of the pivoting mechanism that allow roof spoiler 100 to pivot are possible and are within the scope of this invention. In all embodiments, the roof spoiler preferably rotates approximately ninety degrees from its stowed position to its deployed position, although other angles of rotation advantageously may be used in some configurations.

Figure 14:
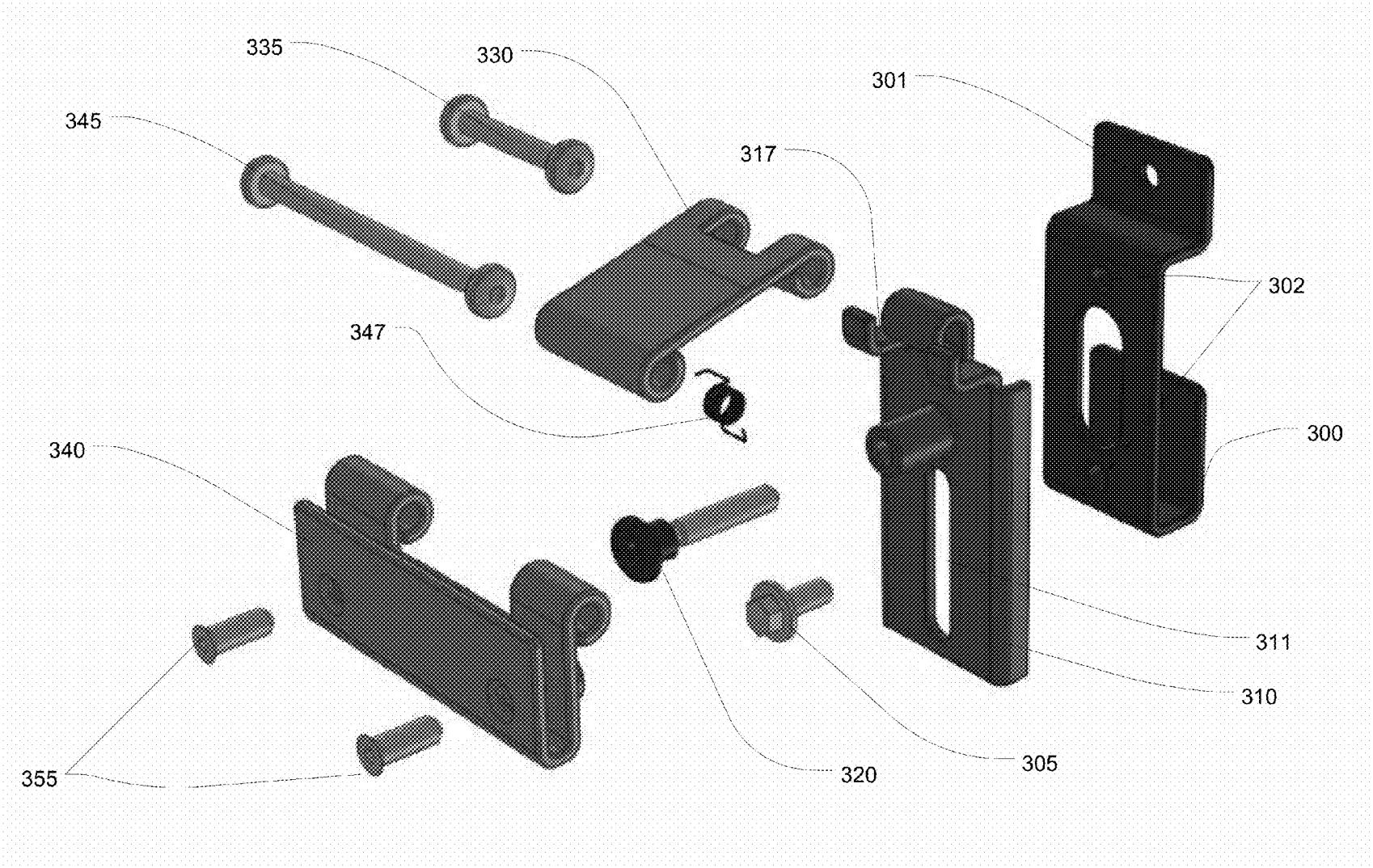
FIG. 14 shows an exploded view of a complex hinge that can be used with the present invention.

FIG. 14 shows an exploded view of a complex hinge that can be used with the present invention. This hinge can be used to perform the functions described above. In this hinge, a wall mounted portion, or bracket 300 is affixed to the fascia, such as by screws or other fasteners, through mounting holes 301. The wall mounted portion, or bracket 300 also has one or more screw holes 302. Adjustable mounted portion 310 may have a slot 311. A screw or bolt 305, having a head larger than the slot, is placed through the slot and into the screw hole 302 in the wall mounted portion, or bracket 300. In this way, adjustable portion 310 may be moved relative to wall mounted portion 300 to accommodate roofs of various thicknesses. When properly positioned, the bolt 305 is then tightened to hold the adjustable mounted portion 310 in place. This combination of wall mounted portion 300, adjustable mounted portion, and bolt 305 may constitute bracket 210, described above.

Adjustable mounted portion 310 may also have a receptacle 317 to hold stop 320. As described above, the stop 320 is used to limit the rotation of the spoiler in one direction (i.e., the rest or stowed position). One end of extension rod 330 is rotatably connected to adjustable mounted portion 310, such as by a hinge pin 335, thereby allowing it freedom of motion. The opposite end of extension rod 330 may be attached to spoiler holder 340 using a second hinge pin 345. Extension rod 330 may be urged toward its stowed position through the use of a biasing element, such as spring 347, which can be used with one or both of the hinge pins 335, 345. Hinge pins 335, 345 may be used to create first pivot 220 and second pivot 250, described above.

The spoiler is connected to the spoiler holder 340, and may be fastened using one or more fasteners 355.

In other embodiments, extension rod 330 and spoiler holder 340 are one unitary part, without a pivoting connection or hinge pin.

The width of the spoiler 100 is preferably equal to, or substantially equal to, the width of the roof. In other words, if the roof is 30 feet wide, the spoiler 100 is preferably also 30 feet wide. In some embodiments, the spoiler is prefabricated in predetermined lengths, such as 4, 8 and 10 foot sections. The widths of the first member and second member are preferably the same, such that the two members are approximately coextensive.

Figure 15:
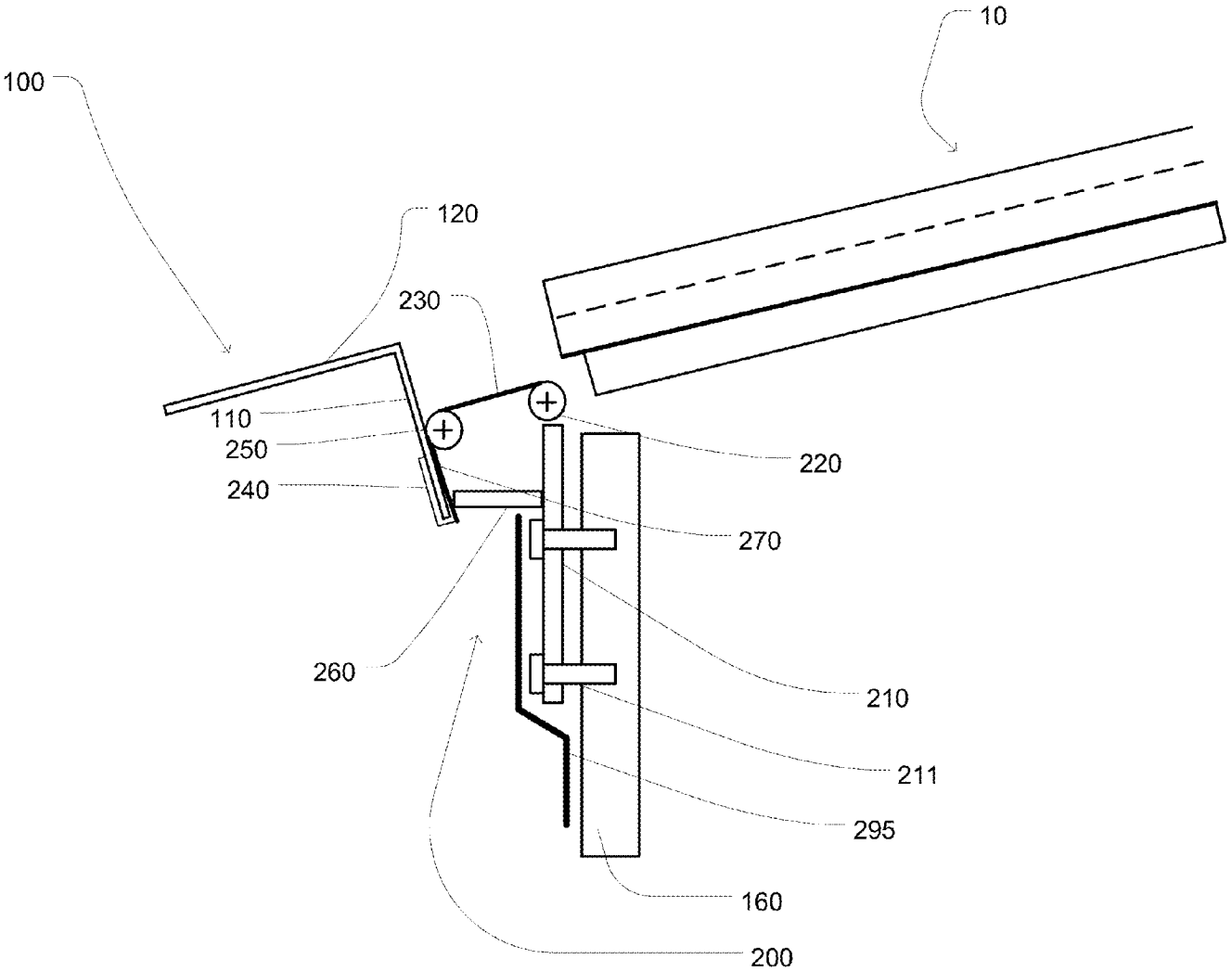
FIG. 15 shows a cover used in conjunction with the spoiler of FIG. 10.

While the above embodiments have been shown in conjunction with a gutter, the invention is not so limited. The present invention can be used without a gutter in the same manner as described above. In embodiments without a gutter, it may be aesthetically pleasing to cover the exposed mounting hardware. FIG. 15 shows the spoiler of FIG. 12 in the stowed position. Cover 295 is shown covering the fasteners 211 and bracket 210, thereby improving the appearance of the spoiler. The cover 295 may be constructed from any suitable material, including metal or plastic. In some embodiments, it can be a prefabricated colored plastic, made to match the color of the fascia.

The cover of FIG. 15 can be used in conjunction with any embodiment. It is preferably used in those embodiments in which there is no gutter, as the gutter hides the hardware in those embodiments. However, the cover 295 may be used in those embodiments as well if desired.

As a further aesthetic embodiment, a feature, such as decorative molding, may be incorporated in the spoiler. In one embodiment, a decorative molding is added at the intersection of the first and second members of the spoiler, so as to improve the appearance of the spoiler. Such an embodiment is typically used in embodiments that do not include a gutter, but the invention is not limited to only these embodiments.

Figure 16:
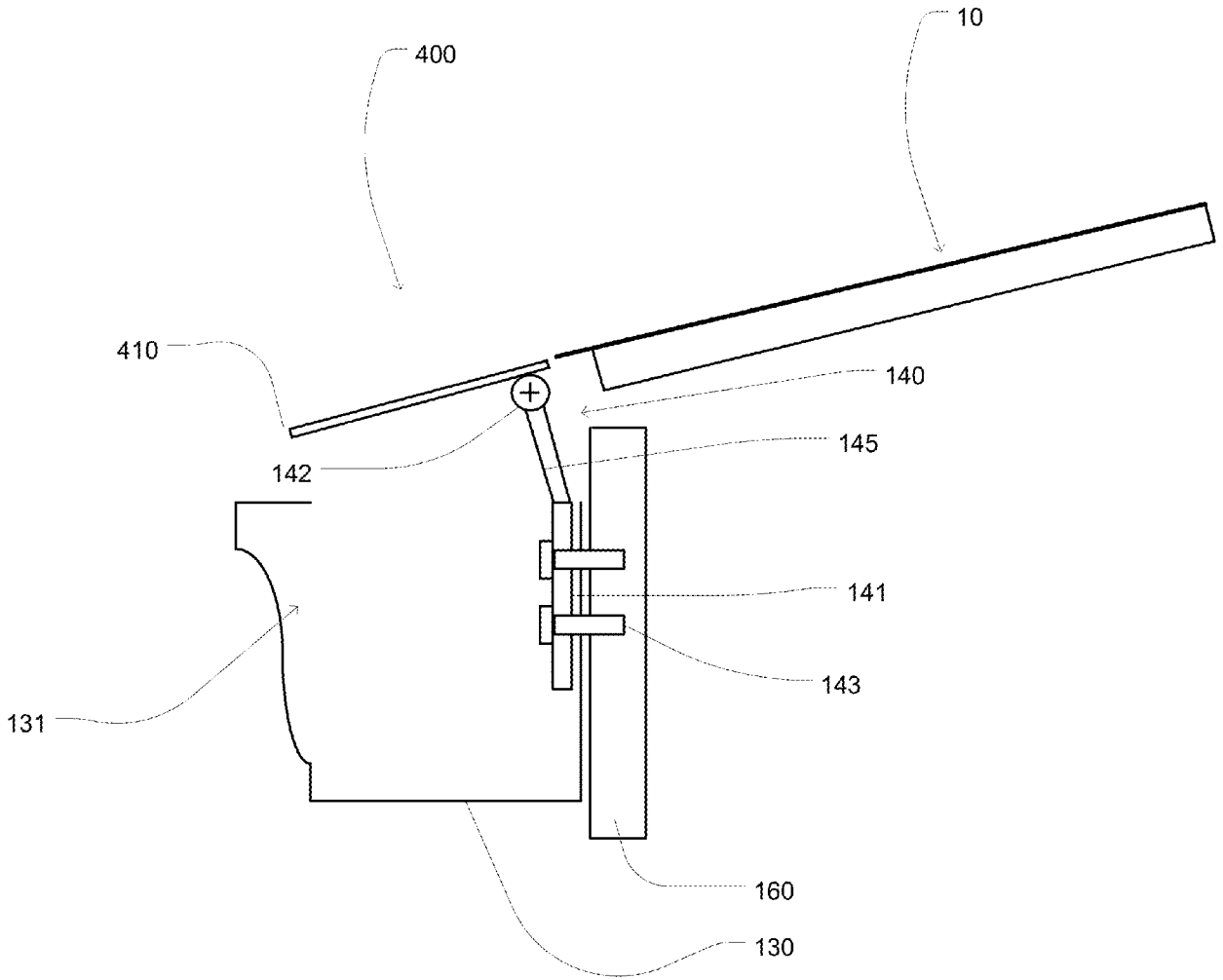
FIG. 16 shows an embodiment of the present invention in the stowed position.
Figure 17:
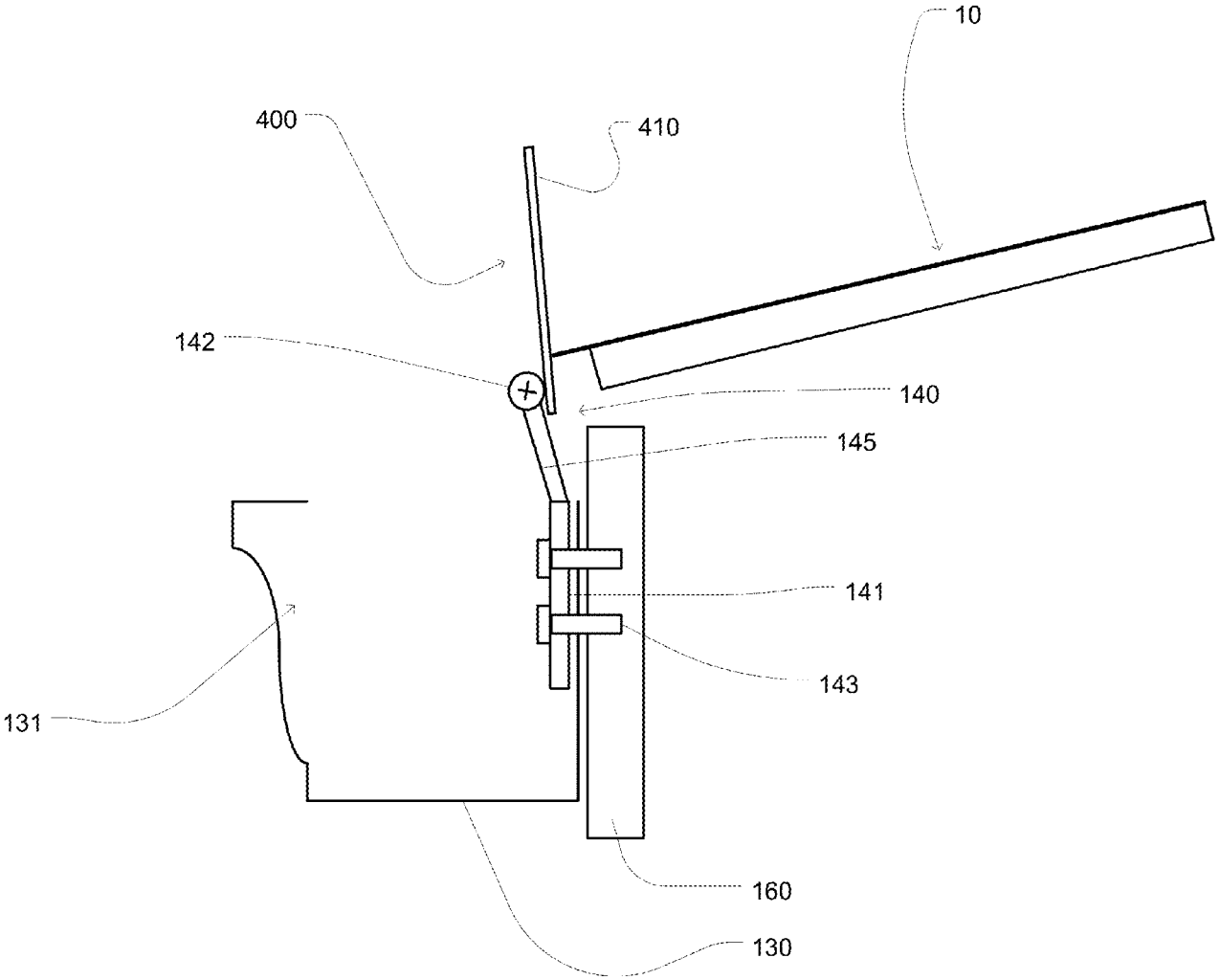
FIG. 17 shows the roof spoiler of FIG. 16 in the deployed position.

The embodiments shown above describe spoilers in which two orthogonal members join together to form an L shape. However, other embodiments are also possible. As described earlier, FIGS. 20*b* and 21*b* show an embodiment where the two members are not orthogonal to one another. FIG. 16 shows an embodiment of a spoiler 400 with a single member 410. The pivoting mechanism 140 can be as described in reference to FIG. 2. Since there are no longer two members, the stop used in conjunction with FIG. 4 must be modified. For example, a hinge having limited rotation may be used. As described above, the presence of strong wind may cause the member 410 to rotate about the axis of rotation or pivoting connection 142, to a deployed position, shown in FIG. 17. In this embodiment, the rotation is limited by the contact of the single member 410 against the roof edge. In other embodiments, the single member 410 may contact the fascia 160. Since the member 410 begins below the roof line, this configuration also serves as a wind guard as described earlier. However, this configuration does not exert downward force on the roof shingles, as was done with the device depicted in FIG. 13.

Figure 18:
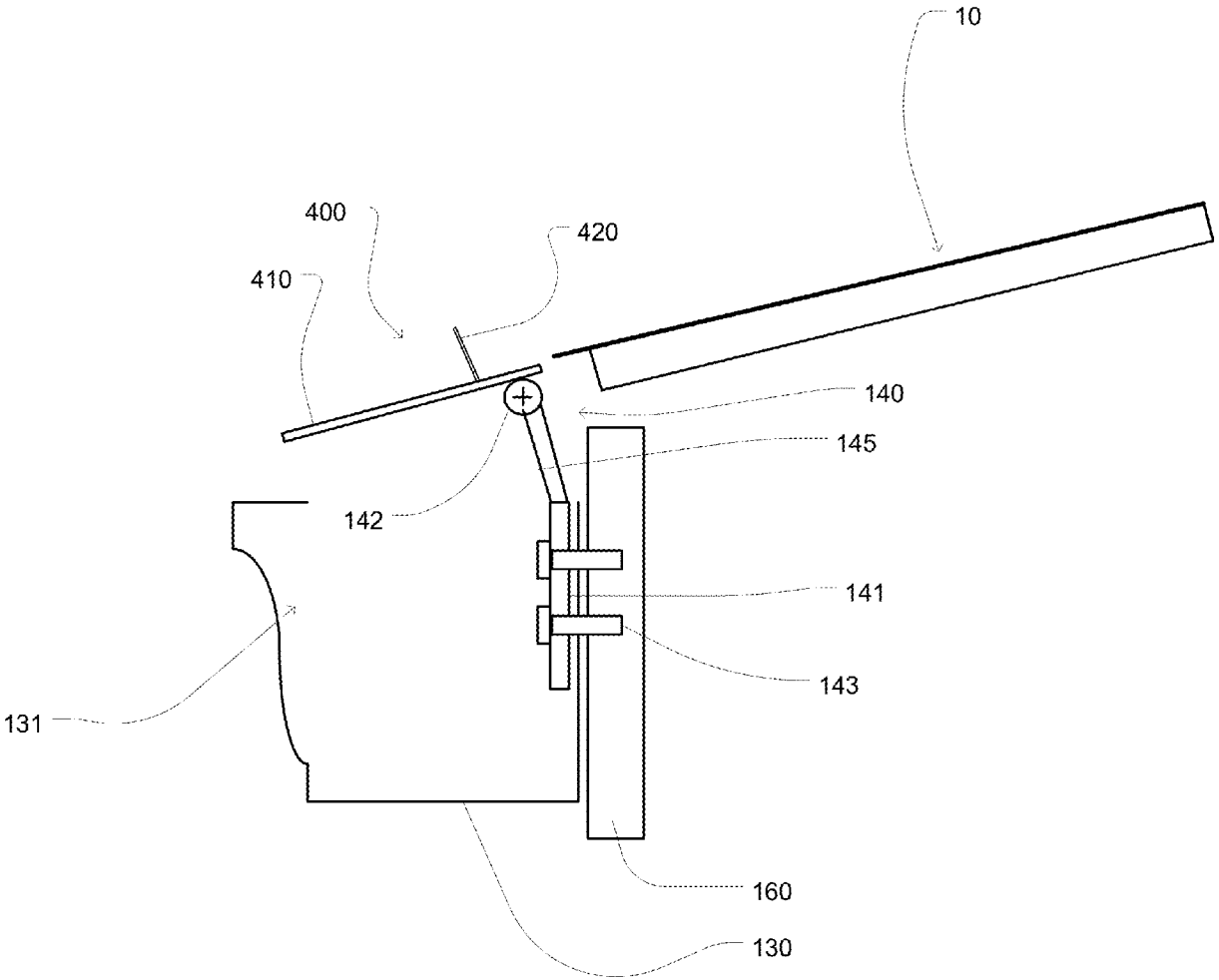
FIG. 18 shows a modification to the embodiment shown in FIG. 16.
Figure 19:
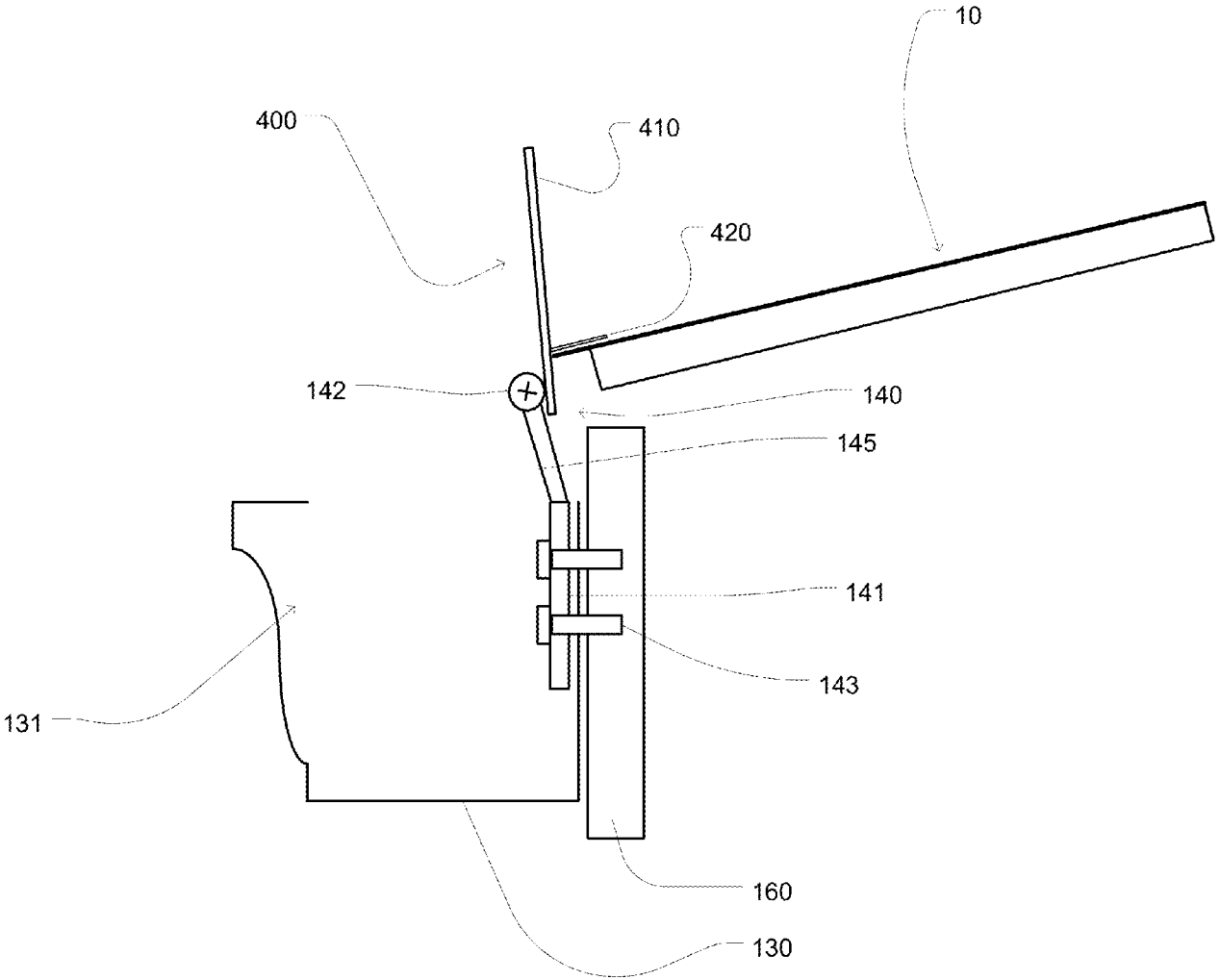
FIG. 19 shows the roof spoiler of FIG. 18 in the deployed position.

FIG. 18 shows a modification to the embodiment of FIG. 16. In this embodiment, a small support 420 is added to the back side of the single member 410. This support 420 is located such that when the spoiler is in the deployed position, as shown in FIG. 19, the support 420 rests on the roof shingles. In some embodiments, the small support 420 is an integral part of the single member 410. For example, the support 420 may be formed (e.g., extruded or molded) as part of member 410. In other embodiments, the support 420 can be affixed to the member 410, such as by fasteners. This allows the support 420 to be positioned specifically for a particular roof thickness. For example, member 410 may have a connection mechanism, wherein the support 420 can be movably affixed to the member 410, thereby allowing easy adjustment during installation. In embodiments where the member 410 is orthogonal to the roof surface, support 420 may extend orthogonally from member 410. In embodiments where the member 410 is not orthogonal to the roof surface, such as when it is in a vertical position, the support may extend at an angle between 60° and 90°.

The support 420 shown in FIG. 18 can also be applied to the embodiments shown in FIGS. 2-5 and FIG. 20-21 if desired so as to allow the spoiler to exert a downward force on the shingles.

The invention claimed is:

1. A method of reducing wind damage to a roof, comprising:

providing a wind spoiler device; said wind spoiler device comprising a wind spoiler having a first member and a second member, said first member having a first length and a first width and said second member having a second length and a second width, wherein said first width is approximately coextensive with said second width, said first member being affixed to said second member along their respective widths such that said second member extends from said first member at an angle of about 60° to 120°; and a bracket adapted to attach to the fascia of a roof; said wind spoiler first member being pivotally connected to said bracket by a freely pivotal mechanical hinge such that said wind spoiler may freely rotate from a stowed position, wherein said second member extends outwardly from said bracket at an angle of about 60° to about 90°, to a deployed position and then returns from said deployed position to said stowed position by the force of gravity, wherein said second member extends upwardly from said bracket at an angle of about 140° to about 180°; and mounting said bracket of said wind spoiler device to the fascia of said roof;

wherein said fascia includes a gutter affixed thereto and wherein said bracket is affixed to said fascia through said gutter.

2. The method of claim 1, wherein said first member is configured to extend into said gutter when said wind spoiler is in said stowed position.

3. The method of claim 1, wherein said second member is configured to extend over said gutter when said wind spoiler is in said stowed position.

4. The method of claim 1,wherein said bracket includes a stop to limit the rotation of said wind spoiler in one direction.

5. The method of claim 1, wherein said fascia limits the rotation of said wind spoiler in one direction.

6. The method of claim 1, wherein the length of said first member is less than the length of said second member.

7. The method of claim 2, wherein said first member is pivotally connected to said bracket via a hinge.

8. The method of claim 1, further comprising installing a cover adapted to conceal said bracket.

9. The method of claim 1, wherein said second member is configured so that a portion of said second member contacts said roof when said wind spoiler is in said deployed position.

10. The method of claim 1, wherein said first member and said second member are orthogonal to one another.

11. A combination to redirect the flow of air over a roof, comprising:

a roof;

a fascia located at the edge of said roof;

a wind spoiler device attached to said fascia, said wind spoiler device comprising a wind spoiler having a first member and a second member, said first member having a first length and a first width and said second member having a second length and a second width, wherein said first width is approximately coextensive with said second width, said first member being affixed to said second member along their respective widths such that said second member extends from said first member at an angle of about 60° to 120°; and a bracket adapted to attach to the fascia of a roof; said wind spoiler first member being pivotally connected to said bracket by a freely pivotal mechanical hinge such that said wind spoiler may freely rotate from a stowed position, wherein said second member extends outwardly from said bracket at an angle of about 60° to about 90°, to a deployed position and then returns from said deployed position to said stowed position by the force of gravity, wherein said second member extends upwardly from said bracket at an angle of about 140° to about 180°;

wherein said bracket is attached to said fascia through a gutter affixed to said fascia.

12. The combination of claim 11, wherein said first member extends into said gutter when said wind spoiler is in said stowed position.

13. The combination of claim 11, wherein said second member extends over said gutter when said wind spoiler is in said stowed position.

14. The combination of claim 11, wherein said bracket includes a stop to limit the rotation of said wind spoiler in one direction.

15. The combination of claim 11, wherein the length of said first member is less than the length of said second member.

16. The combination of claim 11, wherein said fascia limits the rotation of said wind spoiler in one direction.

17. The combination of claim 11, further comprising a cover adapted to conceal said bracket.

18. The combination of claim 11, wherein a portion of said second member contacts said roof when said wind spoiler is in said deployed position.

19. The combination of claim 11, wherein said first member and said second member are orthogonal to one another.

20. The combination of claim 11, wherein said fascia limits the rotation of said spoiler is limited in one direction.

* * * * *